US009805729B2

(12) United States Patent
Shi et al.

(10) Patent No.: US 9,805,729 B2
(45) Date of Patent: Oct. 31, 2017

(54) ENCODING DEVICE AND METHOD, DECODING DEVICE AND METHOD, AND PROGRAM

(71) Applicant: SONY CORPORATION, Tokyo (JP)

(72) Inventors: Runyu Shi, Tokyo (JP); Yuki Yamamoto, Tokyo (JP); Toru Chinen, Kanagawa (JP); Mitsuyuki Hatanaka, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 8 days.

(21) Appl. No.: 14/893,909

(22) PCT Filed: May 21, 2014

(86) PCT No.: PCT/JP2014/063409

§ 371 (c)(1),
(2) Date: Nov. 24, 2015

(87) PCT Pub. No.: WO2014/192602

PCT Pub. Date: Dec. 4, 2014

(65) Prior Publication Data

US 2016/0133261 A1 May 12, 2016

(30) Foreign Application Priority Data

May 31, 2013 (JP) ..... 2013-115724

(51) Int. Cl.
*G10L 19/008* (2013.01)
*H04S 5/02* (2006.01)
(Continued)

(52) U.S. Cl.
CPC ..... *G10L 19/008* (2013.01); *G10L 19/167* (2013.01); *G10L 19/22* (2013.01);
(Continued)

(58) Field of Classification Search
CPC ..... G10L 19/008; G10L 19/167; G10L 19/22; H04S 3/002; H04S 3/02; H04S 5/005;
(Continued)

(56) References Cited

U.S. PATENT DOCUMENTS

2009/0164225 A1* 6/2009 Cho ..... G10L 19/008 704/500
2011/0060599 A1* 3/2011 Kim ..... H04S 7/30 704/501
2014/0133683 A1* 5/2014 Robinson ..... H04S 3/008 381/303

FOREIGN PATENT DOCUMENTS

JP 2009-522610 A 6/2009
JP 2009-526467 A 7/2009
(Continued)

OTHER PUBLICATIONS

Ville Pulkki, "Virtual Sound Source of Positioning Using Vector Base Amplitude Panning", Journal,Sep. 3, 2014, pp. 456-466,vol. 45, No. 6, Audio Engineering Society, Finland.

*Primary Examiner* — David Ton
(74) *Attorney, Agent, or Firm* — Chip Law Group

(57) ABSTRACT

The present technique relates to an encoding device and a method, a decoding device and a method, and a program capable of obtaining higher quality audio. An encoding unit encodes position information and a gain of an object in a current frame in multiple encoding modes. A compressing unit generates, for each combination of encoding modes of each pieces of position information and gains, encoded meta data including encoding mode information indicating the encoding modes and encoded data which are the encoded position information and gains, and compresses the encoding mode information included in the encoding meta data. A determining unit selects encoded meta data of which amount of data is the least from among the encoded meta data
(Continued)

generated for each combination, thus determining the encoding mode of each pieces of position information and gains. The present technique can be applied to an encoder and a decoder.

20 Claims, 14 Drawing Sheets

(51) Int. Cl.

| | |
|---|---|
| ***G10L 19/22*** | (2013.01) |
| ***G10L 19/16*** | (2013.01) |
| ***H04S 3/00*** | (2006.01) |
| ***H04S 3/02*** | (2006.01) |
| ***H04S 5/00*** | (2006.01) |

(52) U.S. Cl.
CPC ..... *H04S 3/002* (2013.01); *H04S 3/02* (2013.01); *H04S 5/005* (2013.01); *H04S 5/02* (2013.01); *H04S 2400/01* (2013.01); *H04S 2400/15* (2013.01); *H04S 2420/01* (2013.01); *H04S 2420/03* (2013.01)

(58) Field of Classification Search
CPC .... H04S 5/02; H04S 2400/01; H04S 2400/15; H04S 2420/01; H04S 2420/03
USPC ..... 381/22, 23
See application file for complete search history.

(56) References Cited

FOREIGN PATENT DOCUMENTS

| | | | |
|---|---|---|---|
| JP | 2009-543389 | A | 12/2009 |
| JP | 2010-515099 | A | 5/2010 |
| JP | 2010-521002 | A | 6/2010 |
| WO | 2010/109918 | A1 | 9/2010 |

* cited by examiner

ENCODING DEVICE AND METHOD, DECODING DEVICE AND METHOD, AND PROGRAM

TECHNICAL FIELD

The present technique relates to an encoding device and a method, a decoding device and a method, and a program, and, more particularly, relates to an encoding device and a method, a decoding device and a method, and a program capable of obtaining higher quality audio.

BACKGROUND ART

In the past, VBAP (Vector Base Amplitude Panning) is known as a technique for controlling localization of an acoustic image using multiple speakers (for example, see Non-Patent Document 1).

In the VBAP, the localization position of the acoustic image, which is the target, is expressed as a linear sum of vectors in directions of two or three speakers around the localization position. Then, the coefficient multiplying each vector in the linear sum is used as the gain of audio that is output from each speaker to perform gain adjustment, so that the acoustic image is localized at the position, which is the target.

CITATION LIST

Non-Patent Document

Non-Patent Document 1: Ville Pulkki, "Virtual Sound Source Positioning Using Vector Base Amplitude Panning", Journal of AES, vol. 45, no. 6, pp. 456-466, 1997

SUMMARY OF THE INVENTION

Problems to be Solved by the Invention

By the way, in the multi-channel audio play back, if it is possible to obtain the audio data of the sound source as well as the position information about the sound source, then, the acoustic image localization position of each sound source can be defined correctly, and therefore, the audio play back can be realized with a higher degree of presence.

However, when meta data such as the audio data of the sound source and the position information about the sound source are transferred to a play back device, the amount of data of the audio data needs to be reduced if the amount of data of the meta data is large when the bit rate of the data transfer is specified. In this case, the quality of the audio of the audio data is reduced.

The present technique is made in view of such circumstances, and it is an object of the present technique to be able to obtain higher quality audio.

Solutions to Problems

An encoding device according to a first aspect of the present technique includes: an encoding unit for encoding position information about a sound source at a predetermined time in accordance with a predetermined encoding mode on the basis of the position information about the sound source at a time before the predetermined time; a determining unit for determining any one of a plurality of encoding modes as the encoding mode of the position information; and an output unit for outputting encoding mode information indicating the encoding mode determined by the determining unit and the position information encoded in the encoding mode determined by the determining unit.

The encoding mode may be a RAW mode in which the position information is adopted as the encoded position information as it is, a stationary mode in which the position information is encoded while the sound source is assumed to be stationary, a constant speed mode in which the position information is encoded while the sound source is assumed to be moving with a constant speed, a constant acceleration mode in which the position information is encoded while the sound source is assumed to be moving with a constant acceleration, or a residual mode in which the position information is encoded on the basis of a residual of the position information.

The position information may be an angle in a horizontal direction, an angle in a vertical direction, or a distance indicating a position of the sound source.

The position information encoded in the residual mode may be information indicating a difference of an angle serving as the position information.

In a case where, with regard to the plurality of sound sources, the encoding modes of the position information of all the sound sources at the predetermined time are the same as the encoding mode at an immediately previous time of the predetermined time, the output unit may not output the encoding mode information.

In a case where, at the predetermined time, the encoding modes of the position information of some of a plurality of sound sources are different from the encoding mode at an immediately previous time of the predetermined time, the output unit may output, of all the encoding mode information, only the encoding mode information of the position information of the sound sources of which encoding modes are different from that of the immediately previous time.

The encoding device may further include: a quantization unit for quantizing the position information with a predetermined quantizing width; and a compression rate determining unit for determining the quantizing width on the basis of a feature quantity of the audio data of the sound source, and the encoding unit may encode the quantized position information.

The encoding device may further include a switching unit for switching the encoding mode in which the position information is encoded on the basis of the amount of data of the encoding mode information and the encoded position information which have been output in past The encoding unit may further encode a gain of the sound source, and the output unit may further output the encoding mode information of the gain the encoded gain.

An encoding method or a program according to the first aspect of the present technique includes the steps of: encoding position information about a sound source at a predetermined time in accordance with a predetermined encoding mode on the basis of the position information about the sound source at a time before the predetermined time; determining any one of a plurality of encoding modes as the encoding mode of the position information; and outputting encoding mode information indicating the encoding mode determined and the position information encoded in the encoding mode determined.

In the first aspect of the present technique, position information about a sound source at a predetermined time is encoded in accordance with a predetermined encoding mode on the basis of the position information about the sound source at a time before the predetermined time, and any one of a plurality of encoding modes is determined as the encoding mode of the position information, and encoding mode information indicating the encoding mode determined and the position information encoded in the encoding mode determined are output.

A decoding device according to a second aspect of the present technique includes: an obtaining unit for obtaining encoded position information about a sound source at a predetermined time and encoding mode information indicating an encoding mode, in which the position information is encoded, of a plurality of encoding modes; and a decoding unit for decoding the encoded position information at the predetermined time in accordance with a method corresponding to the encoding mode indicated by the encoding mode information on the basis of the position information about the sound source at a time before the predetermined time.

The encoding mode may be a RAW mode in which the position information is adopted as the encoded position information as it is, a stationary mode in which the position information is encoded while the sound source is assumed to be stationary, a constant speed mode in which the position information is encoded while the sound source is assumed to be moving with a constant speed, a constant acceleration mode in which the position information is encoded while the sound source is assumed to be moving with a constant acceleration, or a residual mode in which the position information is encoded on the basis of a residual of the position information.

The position information may be an angle in a horizontal direction, an angle in a vertical direction, or a distance indicating a position of the sound source.

The position information encoded in the residual mode may be information indicating a difference of an angle serving as the position information.

In a case where, with regard to a plurality of sound sources, the encoding modes of the position information of all the sound sources at the predetermined time are the same as the encoding mode at an immediately previous time of the predetermined time, the obtaining unit may obtain only the encoded position information.

In a case where, at the predetermined time, the encoding modes of the position information of some of the plurality of sound sources are different from the encoding mode at an immediately previous time of the predetermined time, the obtaining unit may obtain the encoded position information and the encoding mode information of the position information of the sound sources of which encoding modes are different from that of the immediately previous time.

The obtaining unit may further obtain information about a quantizing width in which the position information is quantized during encoding of the position information, which is determined on the basis of a feature quantity of audio data of the sound source.

A decoding method or a program according to the second aspect of the present technique includes the steps of: obtaining encoded position information about a sound source at a predetermined time and encoding mode information indicating an encoding mode, in which the position information is encoded, of a plurality of encoding modes; and decoding the encoded position information at the predetermined time in accordance with a method corresponding to the encoding mode indicated by the encoding mode information on the basis of the position information about the sound source at a time before the predetermined time.

In the second aspect of the present technique, encoded position information about a sound source at a predetermined time and encoding mode information indicating an encoding mode, in which the position information is encoded, of a plurality of encoding modes are obtained, and the encoded position information at the predetermined time is decoded in accordance with a method corresponding to the encoding mode indicated by the encoding mode information on the basis of the position information about the sound source at a time before the predetermined time.

Effects of the Invention

According to the first aspect and the second aspect of the present technique, higher quality audio can be obtained.

MODE FOR CARRYING OUT THE INVENTION

Embodiments to which the present technique is applied will be hereinafter explained with reference to drawings.

First Embodiment

<Example of Configuration of Audio System>

Figure 1:
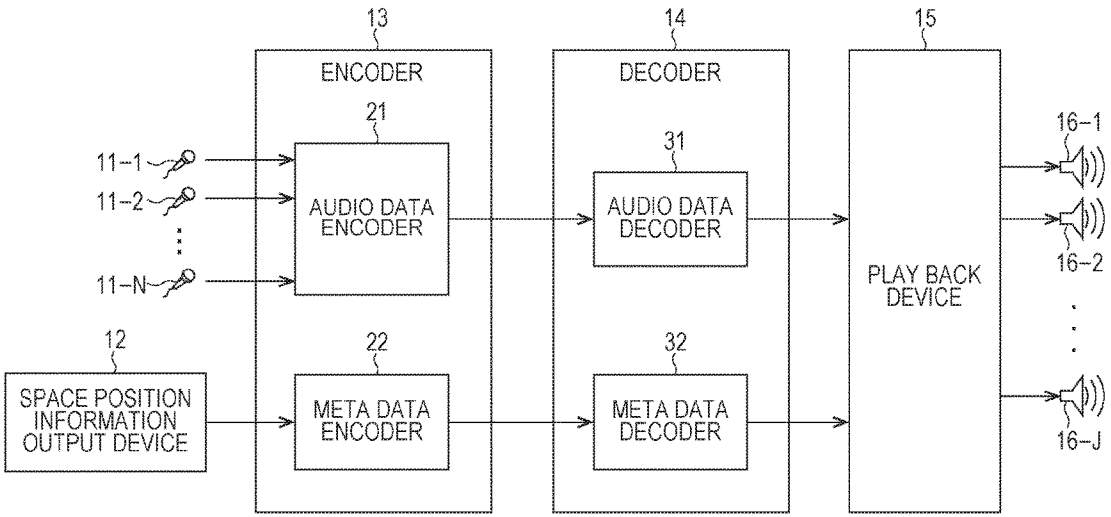
FIG. 1 is a figure illustrating an example of a configuration of an audio system.

The present technique relates to encoding and decoding for compressing the amount of data of meta data, which are information about the sound source, such as information indicating the position of the sound source. FIG. 1 is a figure illustrating an example of a configuration of an embodiment of an audio system to which the present technique is applied.

This audio system includes a microphone 11-1 to a microphone 11-N, a space position information output device 12, an encoder 13, a decoder 14, a play back device 15, and a speaker 16-1 to a speaker 16-J.

The microphone 11-1 to the microphone 11-N are attached to objects serving as, for example, sound sources, and provide audio data obtained by collecting the ambient sounds to the encoder 13. In this case, the object serving as the sound source may be a moving object and the like, which is at rest or moving depending on, for example, a time.

It should be noted that, in a case where it is not necessary to particularly distinguish the microphone 11-1 to the microphone 11-N from each other, the microphone 11-1 to the microphone 11-N may also be hereinafter simply referred to as microphones 11. In the example of FIG. 1, the microphones 11 are attached to N objects which are different from each other.

The space position information output device 12 provides, as the meta data of the audio data, information and the like indicating the position of the object to which the microphone 11 is attached in the space at each time to the encoder 13.

The encoder 13 encodes the audio data provided from the microphone 11 and the meta data provided from the space position information output device 12, and outputs the audio data and the meta data to the decoder 14. The encoder 13 includes an audio data encoder 21 and a meta data encoder 22.

The audio data encoder 21 encodes the audio data provided from the microphone 11, and outputs the audio data to the decoder 14. More specifically, the encoded audio data are multiplexed to be made into a bit stream and transferred to the decoder 14.

The meta data encoder 22 encodes the meta data provided from the space position information output device 12 and provides the meta data to the decoder 14. More specifically, the encoded meta data are described in the bit stream, and are transferred to the decoder 14.

The decoder 14 decodes the audio data and the meta data provided from the encoder 13 and provides the decoded audio data and the decoded meta data to the play back device 15. The decoder 14 includes an audio data decoder 31 and a meta data decoder 32.

The audio data decoder 31 decodes the encoded audio data provided from the audio data encoder 21, and provides the audio data obtained as a result of the decoding to the play back device 15. The meta data decoder 32 decodes the encoded meta data provided from the meta data encoder 22, and provides the meta data obtained as a result of the decoding to the play back device 15.

The play back device 15 adjusts the gain and the like of the audio data provided from the audio data decoder 31 on the basis of the meta data provided from the meta data decoder 32, and, as necessary, the play back device 15 provides the audio data, which have been adjusted, to the speaker 16-1 to the speaker 16-J. The speaker 16-1 to the speaker 16-J play the audio on the basis of the audio data provided from the play back device 15. Therefore, the acoustic image can be localized at the position, in the space, corresponding to each object, and the audio play back can be realized with a high degree of presence.

It should be noted that, in a case where it is not necessary to particularly distinguish the speaker 16-1 to the speaker 16-J from each other, the speaker 16-1 to the speaker 16-J may also be hereinafter simply referred to as speakers 16.

By the way, in a case where the total bit rate is defined in advance for the transfer of the audio data and the meta data exchanged between the encoder 13 and the decoder 14, and the amount of data of the meta data is large, the amount of data of the audio data is required to be reduced accordingly. In this case, the sound quality of the audio data is degraded.

Therefore, in the present technique, the encoding efficiency of the meta data is improved to compress the amount of data, so that higher quality audio data can be obtained.

<Meta-Data>

First, the meta data will be explained.

The meta data provided from the space position information output device 12 to the meta data encoder 22 are data related to an object including data for identifying the position of each of N objects (sound sources). For example, the meta data include the following five pieces of information as shown in the following (D1) to (D5) for each object.

(D1) Index indicating an object (D2) Angle θ in the horizontal direction of object (D3) Angle γ in the vertical direction of object (D4) Distance r from object to listener (D5) Gain g of audio of object More specifically, such meta data are provided to the meta data encoder 22 with every predetermined interval of time and for each frame of audio data of the object.

Figure 2:
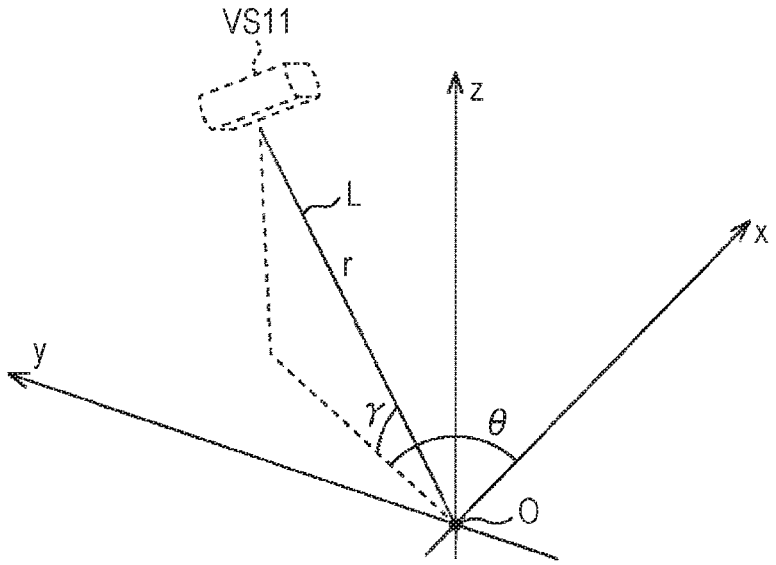
FIG. 2 is a figure for explaining meta data of an object.

For example, as shown in FIG. 2, a three-dimensional coordinate system is considered, in which the position of the listener who is listening to the audio that is output from the speaker 16 (not shown) is defined as the point of origin O, and the upper right direction, the upper left direction, and the upper direction in the drawing are defined as the directions of x axis, y axis, and z axis which are perpendicular to each other. At this occasion, where the sound source corresponding to a single object is defined as a virtual sound source VS11, the acoustic image may be localized at the position of the virtual sound source VS11 in the three-dimensional coordinate system.

At this occasion, for example, information indicating the virtual sound source VS11 is adopted as an index indicating the object included in the meta data, and the index has any one of the values of the N discrete values.

For example, where a straight line connecting the virtual sound source VS11 and the point of origin O is defined as a straight line L, the angle (azimuth) in the horizontal direction, in the drawing, formed by the straight line L and the x axis on the xy plane is the angle θ in the horizontal direction included in the meta data, and the angle θ in the horizontal direction is any given value satisfying $-180° \leq \theta \leq 180°$.

Further, the angle formed by the straight line L and the xy plane, i.e., the angle in the vertical direction (the angle of elevation) in the drawing, is the angle γ in the vertical direction included in the meta data, and the angle γ in the vertical direction is any given value satisfying $-90° \leq \gamma \leq 90°$. The length of the straight line L, i.e., the distance from the point of origin O to the virtual sound source VS11 is the distance r to the listener included in the meta data, and the distance r is a value equal to or more than 0. More specifically, the distance r is a value satisfying $0 \leq r \leq \infty$.

The angle θ in the horizontal direction, the angle γ in the vertical direction, and the distance r of each object included in the meta data are information indicating the position of the object. In the following explanation, in a case where it is not necessary to particularly distinguish the angle θ in the horizontal direction, the angle γ in the vertical direction, and the distance r of the object from each other, the angle θ in the horizontal direction, the angle γ in the vertical direction, and the distance r of the object may also be hereinafter simply referred to as position information about the object.

When gain adjustment of the audio data of the object is performed on the basis of the gain g, the audio can be output with a desired sound volume.

<Encoding of Meta Data>

Subsequently, encoding of the meta data explained above will be explained.

During encoding of the meta data, the position information and the gain of the object are encoded in processing of two steps (E1) and (E2) shown below. In this case, the processing shown in (E1) is encoding processing in the first step, and the processing shown in (E2) is encoding processing in the second step.

(E1) The position information and the gain of each object are quantized.

(E2) The position information and the gain thus quantized are further compressed in accordance with the encoding mode.

It should be noted that there are three types of encoding modes (F1) to (F3) as shown below.

(F1) RAW mode (F2) Motion pattern prediction mode (F3) Residual mode

The RAW mode as shown in (F1) is a mode for describing, as the encoded position information or the gain, the code obtained in the encoding processing in the first step as shown in (E1) in the bit stream as it is.

The motion pattern prediction mode as shown in (F2) is a mode in which, in a case where the position information or the gain of the object included in the meta data can be predicted from the position information or the gain of the object in the past, the predictable motion pattern is described in the bit stream.

The residual mode as shown in (F3) is a mode for performing encoding on the basis of the residual of the position information or the gain, and more specifically, the residual mode as shown in (F3) is a mode for describing the difference (displacement) of the position information or the gain of the object in the bit stream as the position information or the gain having been encoded.

The encoded meta data that are obtained ultimately include the position information or the gain having been encoded in the encoding mode of any one of the three types of encoding modes as shown in (F1) to (F3) explained above.

The encoding mode is defined for the position information and the gain of each object with regard to each frame of the audio data, but the encoding mode of each piece of position information and gain is defined so that the amount of data (the number of bits) of the meta data ultimately obtained becomes the minimum.

In the following explanation, the encoded meta data, i.e., the meta data which are output from the meta data encoder 22, may also be referred to as encoded meta data in particular.

<Encoding Processing in the First Step>

Subsequently, the processing in the first step and the processing in the second step during the encoding of the meta data will be explained in more details.

First, the processing in the first step during encoding will be explained.

For example, in the encoding processing of the first step, the angle θ in the horizontal direction, the angle γ in the vertical direction, and the distance r, serving as the position information about the object, and the gain g, are respectively quantized.

More specifically, for example, the following expression (1) is calculated for each of the angle θ in the horizontal direction and the angle γ in the vertical direction, and is quantized (encoded) with an interval of, e.g., R degrees.

[Mathematical Formula 1]

$$\mathrm{Code}_{arc}=\mathrm{round}(\mathrm{Arc}_{raw}/R) \quad (1)$$

In the expression (1), $\mathrm{Code}_{arc}$ denotes a code obtained from quantization performed on the angle θ in the horizontal direction or the angle θ in the vertical direction, and $\mathrm{Arc}_{raw}$ denotes the angle before the quantization of the angle θ in the horizontal direction or the angle γ in the vertical direction, and more specifically, $\mathrm{Arc}_{raw}$ denotes the value of θ or γ. In the expression (1), round( ) indicates, for example, a rounding off function, and R denotes a quantizing width indicating the interval of the quantization, and more specifically, R denotes a step size of the quantization.

In the inverse quantization (decoding processing) performed on code $\mathrm{Code}_{arc}$ that is performed during the decoding of the position information, the following expression (2) is calculated with regard to the code $\mathrm{Code}_{arc}$ of the angle θ in the horizontal direction or the angle γ in the vertical direction.

[Mathematical Formula 2]

$$\mathrm{Arc}_{decoded}=\mathrm{Code}_{arc}\times R \quad (2)$$

In the expression (2), $\mathrm{Arc}_{decoded}$ denotes an angle obtained from the inverse quantization performed on the code $\mathrm{Code}_{arc}$, and more specifically, $\mathrm{Arc}_{decoded}$ denotes the angle θ in the horizontal direction or the angle γ in the vertical direction obtained from the decoding.

In a more specific example, for example, suppose that the angle θ in the horizontal direction=−15.35° is quantized in a case where step size R is 1 degrees. At this occasion, when the angle θ in the horizontal direction=−15.35° is substituted into the expression (1), $\mathrm{Code}_{arc}$=round (−15.35/1)=−15 is obtained. In the inverse manner, when the inverse-quantize is performed by substituting the $\mathrm{Code}_{arc}$=−15 obtained from the quantization into the expression (2), $\mathrm{Arc}_{decoded}$=−15×1=−15° is obtained. More specifically, the angle θ in the horizontal direction obtained from the inverse quantization becomes −15 degrees.

For example, suppose that the angle γ in the vertical direction=22.73° is quantized in a case where the step size R is 3 degrees. At this occasion, when the angle γ in the vertical direction=22.73° is substituted into the expression (1), $\mathrm{Code}_{arc}$=round(22.73/3)=8 is obtained. In the inverse manner, when the inverse-quantize is performed by substituting the $\mathrm{Code}_{arc}$=8 obtained from the quantization into the expression (2), $\mathrm{Arc}_{decoded}$=8×3=24° is obtained. More specifically, the angle γ in the vertical direction obtained from the inverse quantization becomes 24 degrees.

<Encoding Processing in the Second Step>

Subsequently, the encoding processing in the second step will be explained.

As explained above, the encoding processing in the second step has, as the encoding mode, three types of modes, i.e., the RAW mode, the motion pattern prediction mode, and the residual mode.

In the RAW mode, the code obtained in the encoding processing of the first step is described, as the position information or the gain having been encoded, in the bit stream as it is. In this case, the encoding mode information indicating the RAW mode, serving as the encoding mode is also described in the bit stream. For example, an identification number indicating the RAW mode is described as the encoding mode information.

In the motion pattern prediction mode, when the position information and the gain of the current frame of the object can be predicted with a prediction coefficient determined in advance from the position information and the gain of a past frame of the object, the identification number of the motion pattern prediction mode corresponding to the prediction coefficient is described in the bit stream. More specifically, the identification number of the motion pattern prediction mode is described as the encoding mode information.

In this case, multiple modes are defined in the motion pattern prediction mode serving as the encoding mode. For example, stationary mode, constant speed mode, constant acceleration mode, P20 sine mode, 2 tone sine mode, and the like are defined in advance as an example of the motion pattern prediction mode. In a case where it is not necessary to particularly distinguish the stationary mode and the like from each other, the stationary mode and the like may also be hereinafter simply referred to as a motion pattern prediction mode.

For example, suppose that the current frame, which is to be processed, is the n-th frame (which may also be hereinafter referred to as frame n), and the code $Code_{arc}$ obtained with regard to the frame n is described as code $Code_{arc}(n)$.

A frame which is k frames before the frame n (where $1 \leq k \leq K$) in time is defined as a frame (n−k), and a code $Code_{arc}$ obtained with regard to the frame (n−k) is expressed as code $Code_{arc}(n-k)$.

Further, suppose that prediction coefficients $a_{ik}$ for K frames (n−k) are defined in advance for each identification number i of each of the motion pattern prediction modes such as the stationary mode in the identification numbers serving as the encoding mode information.

At this occasion, in a case where code $Code_{arc}(n)$ can be expressed with the following expression (3) by using the prediction coefficient $a_{ik}$ defined in advance for each motion pattern prediction mode such as the stationary modes, the identification number i of the motion pattern prediction mode is described as the encoding mode information in the bit stream. In this case, if the decoding side of the meta data can obtain the prediction coefficient defined with regard to the identification number i of the motion pattern prediction mode, the position information can be obtained with the prediction using the prediction coefficient, and therefore, in the bit stream, the encoded position information is not described.

[Mathematical Formula 3]

$$Code_{arc}(n)=Code_{arc}(n-1)\times a_{i1}+Code_{arc}(n-2)\times a_{i2}+\ldots+Code_{ark}(n-K)\times a_{iK} \quad (3)$$

In the expression (3), the summation of codes $Code_{arc}(n-k)$ of the past frames multiplied by the prediction coefficient $a_{ik}$ is defined as the code $Code_{arc}(n)$ of the current frame.

More specifically, for example, suppose that $a_{i1}=2$, $a_{i2}=-1$, and $a_{ik}=0$ (where $k \neq 1, 2$) are defined as the prediction coefficient $a_{ik}$ of the identification number i, and code $Code_{arc}(n)$ can be predicted from the expression (3) by using these prediction coefficients. More specifically, suppose that the following expression (4) is satisfied.

[Mathematical Formula 4]

$$Code_{arc}(n)=Code_{arc}(n-1)\times 2-Code_{arc}(n-2)\times 1 \quad (4)$$

In this case, the identification number i indicating the encoding mode (motion pattern prediction mode) is described as the encoding mode information in the bit stream.

In the example of the expression (4), in the three continuous frames including the current frame, the differences of the angle (position information) of the adjacent frames are the same. More specifically, the difference of the position information about the frame (n) and the frame (n−1) is the same as the difference of the position information about the frame (n−1) and the frame (n−2). The difference of the position information about the adjacent frames indicates the speed of the object, and therefore, in a case where the expression (4) is satisfied, the object moves with a constant angular speed.

As described above, the motion pattern prediction mode for predicting the position information about the current frame with the expression (4) will be referred to as a constant speed mode. For example, the identification number i indicating the constant speed mode serving as the encoding mode (motion pattern prediction mode) is "2", the prediction coefficient $a_{2k}$ of the constant speed mode are $a_{21}=2$, $a_{22}=-1$, and $a_{2k}=0$ (where $k \neq 1, 2$).

Likewise, suppose that the object is stationary, and a motion pattern prediction mode in which the position information or the gain of a past frame is adopted as, as it is, the position information or the gain of the current frame is defined as the stationary mode. For example, in a case where the identification number i indicating the stationary mode serving as the encoding mode (motion pattern prediction mode) is "1", the prediction coefficients $a_{1k}$ of the stationary mode are $a_{11}=1$, and $a_{1k}=0$ (where $k \neq 1$).

Further, suppose that the object is moving with a constant acceleration, and a motion pattern prediction mode in which the position information or the gain of the current frame is expressed from the position information or the gain of past frames is defined as the constant acceleration mode. For example, in a case where the identification number i indicating the constant acceleration mode serving as the encoding mode is "3", the prediction coefficients $a_{3k}$ of the constant acceleration mode are $a_{31}=3$, $a_{32}=-3$, $a_{33}=1$, and $a_{3k}=0$ (where $k \neq 1, 2, 3$). The reason why the prediction coefficients are thus defined is because the difference of the position information between adjacent frames represents the speed, and the difference of the speeds thereof is the acceleration.

When the motion of the angle θ in the horizontal direction of the object is a sine motion of a cycle of 20 frames as shown in the following expression (5), the position information about the object can be predicted with the expression (3) by using $a_{i1}=1.8926$, $a_{i2}=-0.99$, and $a_{ik}=0$ (where $k \neq 1, 2$) as the prediction coefficient $a_{ik}$. It should be noted that, in the expression (5), Arc(n) denotes an angle in the horizontal direction.

[Mathematical Formula 5]

$$Arc(n) = \alpha \times \sin\left(\frac{\pi n}{10} + \phi\right);\ (-180° \leq \alpha \leq 180°)(-\pi \leq \phi \leq \pi) \quad (5)$$

A motion pattern prediction mode for predicting the position information about the object making a sine motion as shown in the expression (5) by using such prediction coefficient $a_{ik}$ is defined as a P20 sine mode.

Further, suppose that the motion of the object with an angle γ in the vertical direction is the summation of a sine motion with a cycle of 20 frames and a sine motion with a cycle of 10 frames as shown in the following expression (6). In such case, when $a_{i1}=2.324$, $a_{i2}=-2.0712$, $a_{i3}=0.665$, and $a_{ik}=0$ (where $k \neq 1, 2, 3$) are used as the prediction coefficients $a_{ik}$ the position information about the object can be predicted from the expression (3). It should be noted that, in the expression (6), Arc(n) denotes an angle in the vertical direction.

[Mathematical Formula 6]

$$Arc(n) = \alpha \times \left(\sin\left(\frac{\pi n}{10} + \phi\right) + \sin\left(\frac{\pi n}{5} + \psi\right)\right);\ (-45° \leq \alpha \leq 45°)\ (-\pi \leq \phi, \psi \leq \pi) \quad (6)$$

A motion pattern prediction mode for predicting the position information about the object making a motion as shown in the expression (6) by using such prediction coefficient $a_{ik}$ is defined as a 2 tone sine mode.

In the above explanation, five types of modes which are the stationary mode, the constant speed mode, the constant acceleration mode, the P20 sine mode, and the 2 tone sine mode have been explained as an example as encoding modes classified into the motion pattern prediction mode, but, in addition, there may be any type of motion pattern prediction mode. There may be any number of encoding modes classified into the motion pattern prediction mode.

Further, in this case, the specific examples of the angle θ in the horizontal direction and the angle γ in the vertical direction have been explained, but with regard to the distance r and the gain g, the distance and the gain of the current frame can also be expressed by expressions similar to the above expression (3).

In the encoding of the position information and the gain in the motion pattern prediction mode, for example, three types of motion pattern prediction modes are selected from X types of motion pattern prediction modes prepared in advance, and the position information and the gain are predicted with only the selected motion pattern prediction mode (which may also be hereinafter referred to as selected motion pattern prediction mode). Then, the encoded meta data obtained from a predetermined number of frames in the past are used for each frame of audio data, and three types of appropriate motion pattern prediction modes are selected to reduce the amount of data of the meta data, and are adopted as new selected motion pattern prediction modes. More specifically, the motion pattern prediction modes are switched as necessary for each frame.

In this explanation, there are three selected motion pattern prediction modes, but the number of selected motion pattern prediction modes may be any number, and the number of motion pattern prediction modes which are switched may be any number. Alternatively, the motion pattern prediction modes may be switched with multiple frames.

In the residual mode, different processing is performed depending on which of the encoding modes a frame immediately before the current frame is encoded.

For example, in a case where the immediately previous encoding mode is the motion pattern prediction mode, the position information or the gain of the current frame that has been quantized is predicted in accordance with the motion pattern prediction mode. More specifically, using the prediction coefficient defined for a motion pattern prediction mode such as the stationary mode, the expression (3) and the like are calculated, and the prediction value of the position information or the gain of the current frame that has been quantized is derived. In this case, the position information or the gain that has been quantized means the position information or the gain that has been encoded (quantized) obtained from the encoding processing in the first step described above.

Then, when the difference of the prediction value of the current frame obtained and the actual position information or the actual gain of the current frame that has been quantized (actually measured value) is a value of M bits or less when expressed as a binary number, and more specifically, the difference is a value that can be described within M bits, then, the value of the difference is described in the bit stream with M bits as the position information or the gain having been encoded. The encoding mode information indicating the residual mode is also described in the bit stream.

It should be noted that the number of bits M is a value defined in advance, and for example, the number of bits M is defined on the basis of the step size R.

In a case where the immediately previous encoding mode is the RAW mode, and the difference of the position information or the gain of the current frame that has been quantized and the position information or the gain of the immediately previous frame that has been quantized is a value that can be described within M bits, then, the value of the difference is described in the bit stream with M bits as the position information or the gain having been encoded. At this occasion, the encoding mode information indicating the residual mode is also described in the bit stream.

In a case where the encoding is performed in the residual mode in the frame immediately before the current frame, the encoding mode of the first frame in the past that has been encoded in an encoding mode other than the residual mode is adopted as the encoding mode of the immediately previous frame.

Hereinafter, a case where the distance r serving as the position information is not encoded in the residual mode will be explained, but the distance r may also be encoded in the residual mode.

<Bit Compressing of Encoding Mode Information>

In the above explanation, the data such as the position information, the gain, the difference (residual), and the like obtained from encoding in the encoding mode are adopted as the position information or the gain having been encoded, and the encoded position information, the encoded gain, and the encoding mode information are described in the bit stream.

However, the same encoding mode is frequently selected, or the encoding modes for encoding the position information or the gain in the current frame and the immediately previous frame are of the same, and therefore, in the present technique, further, the bit compression of the encoding mode information is performed.

First, in the present technique, the bit compression of the encoding mode information is performed when the identification number of the encoding mode is given which is done as a previous preparation.

More specifically, the reproduction probability of each encoding mode is estimated by statistical learning, and on the basis of the result thereof, the number of bits of the identification number of each encoding mode is determined by Huffman encoding method. Therefore, the number of bits of the identification number (encoding mode information) of an encoding mode of which reproduction probability is high is reduced, so that the amount of data of the encoded meta data can be reduced as compared with a case where the encoding mode information has a fixed bit length.

More specifically, for example, the identification number of the RAW mode is "0", the identification number of the residual mode is "10, the identification number of the stationary mode is "110", the identification number of the constant speed mode is "1110", and the identification number of the constant acceleration mode is "1111".

In the present technique, as necessary, the encoded meta data do not include the same encoding mode information as that of the immediately previous frame, whereby the bit compression of the encoding mode information is performed.

More specifically, in a case where the encoding mode of each piece of information of all the objects of the current frame obtained in the encoding of the second step explained above is the same as the encoding mode of each piece of information of the immediately previous frame, the encoding mode information about the current frame is not transmitted to the decoder 14. In other words, in a case where there is not at all any change in the encoding mode between the current frame and the immediately previous frame, the encoded meta data are made not to include the encoding mode information.

In a case where there is information in which there is even a single change in the encoding mode between the current frame and the immediately previous frame, the description of the encoding mode information is made in accordance with any one of the methods (G1) and (G2) as shown below whichever the amount of data (the number of bits) of the encoded meta data are smaller.

(G1) The encoding mode information of all the pieces of position information and gains is described (G2) The encoding mode information is described only with regard to the position information or the gain having been changed in the encoding mode In a case where the encoding mode information is described in accordance with the method (G2), element information indicating the position information or the gain having been changed in the encoding mode, an index indicating the object of the position information or the gain thereof, and mode change number information indicating the number of pieces of position information and the gains having been changed are further described in the bit stream.

Figure 3:
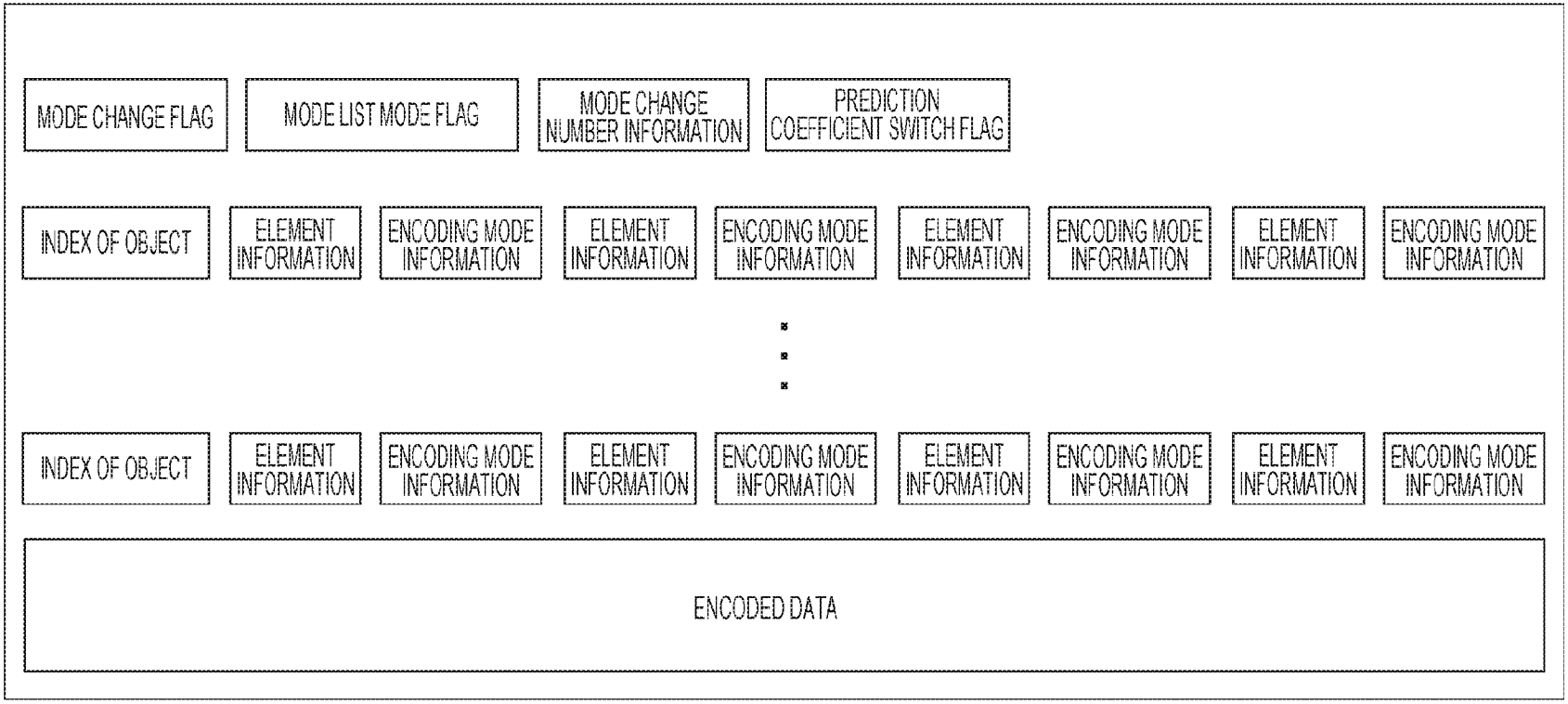
FIG. 3 is a figure for explaining encoded meta data.

According to the processing explained above, information made up with several pieces of information as shown in FIG. 3 is described in the bit stream as the encoded meta data in accordance with the presence/absence of a change in the encoding mode, and the encoded meta data is output from the meta data encoder 22 to the meta data decoder 32.

In the example of FIG. 3, a mode change flag is arranged at the head of the encoded meta data, and subsequently, a mode list mode flag is arranged, and further, thereafter, mode change number information, and prediction coefficient switch flag are arranged.

The mode change flag is information indicating whether the encoding mode of each of the position information and gain of all the objects of the current frame is the same as the encoding mode of each of the position information and gain of the immediately previous frame, and more specifically, the mode change flag is information indicating whether there is a change in the encoding mode or not.

The mode list mode flag is information indicating which of the methods (G1) and (G2) the encoding mode information is described, and is described only in a case where a value indicating that there is a change in the encoding mode is described as a mode change flag.

The mode change number information is information indicating the number of position information and gain in which there is a change in the encoding mode, and more specifically, the mode change number information is information indicating the number of encoding mode information described in a case where encoding mode information is described in accordance with the method (G2). Therefore, this mode change number information is described in the encoded meta data only in a case where the encoding mode information is described in accordance with the method (G2).

The prediction coefficient switch flag is information indicating whether the motion pattern prediction mode is switched or not in the current frame. In a case where the prediction coefficient switch flag indicates that the switching is performed, for example, a prediction coefficient of a new selected motion pattern prediction mode is arranged at an appropriate position such as after the prediction coefficient switch flag.

In the encoded meta data, the index of the object is arranged subsequently to the prediction coefficient switch flag. This index is an index provided from the space position information output device 12 as meta data.

After the index of the object, for each piece of position information and gain, element information indicating the type of the position information or the gain thereof and encoding mode information indicating the encoding mode of the position information or the gain are arranged in order.

In this case, the position information or the gain indicated by the element information is any one of the angle θ in the horizontal direction of the object, the angle γ in the vertical direction of the object, the distance r from the object to the listener, and the gain g. Therefore, after the index of the object, up to four sets of element information and encoding mode information are arranged.

For example, for three pieces of position information and a single piece of gain, the order in which the sets of element information and encoding mode information are arranged is determined in advance.

The index of the object, the element information and the encoding mode information of the object are arranged for each object in order in the encoded meta data.

In the example of FIG. 1, there are N objects, and therefore, the index of the object, the element information, and the encoding mode information are arranged in the order of the value of the index of the object with regard to up to N objects.

Further, in the encoded meta data, the position information or the gain having been encoded is arranged as encoded data after the index of the object, the element information, and the encoding mode information. The encoded data are data for obtaining the position information or the gain required to decode the position information or the gain in accordance with the method corresponding to the encoding mode indicated by the encoding mode information.

More specifically, the difference of the position information and the gain having been quantized obtained from the encoding in the RAW mode in code $Code_{arc}$ and the like as shown in the expression (1) and the position information and the gain having been quantized and obtained in the encoding in the residual mode are arranged as the encoded data as shown in FIG. 3. It should be noted that the order in which the encoded data of the position information and the gain of each object are arranged is, e.g., the order in which the encoding mode information about the position information and the gain thereof are arranged.

When the encoding processing in the first step and the second step explained above is performed during the encoding of the meta data, the encoding mode information about each pieces of position information and gains and the encoded data are obtained.

When the encoding mode information and the encoded data are obtained, the meta data encoder 22 determines whether there is a change in the encoding mode between the current frame and the immediately previous frame.

Then, in a case where there is no change in the encoding mode of each pieces of position information and gains of all the objects, the mode change flag, the prediction coefficient switch flag, and the encoded data are described in the bit stream as the encoded meta data. As necessary, the prediction coefficient is described in the bit stream. More specifically, in this case, the mode list mode flag, the mode change number information, the index of the object, the element information, and the encoding mode information are not transmitted to the meta data decoder 32.

In a case where there is a change in the encoding mode, and the encoding mode information is described in accordance with the method of (G1), the mode change flag, the mode list mode flag, the prediction coefficient switch flag, the encoding mode information, and the encoded data are described in the bit stream as the encoded meta data. Then, as necessary, the prediction coefficient is also described in the bit stream.

Therefore, in this case, the mode change number information, the index of the object, and the element information are not transmitted to the meta data decoder 32. In this example, all the pieces of encoding mode information are transmitted in an arrangement in the order defined in advance, and therefore, even if the index of the object and the element information are not provided, it is possible to identify for which position information and gain of which object each piece of encoding mode information is indicating the encoding mode.

Further, in a case where there is a change in the encoding mode, and the encoding mode information is described in accordance with the method of (G2), the mode change flag, the mode list mode flag, the mode change number information, the prediction coefficient switch flag, the index of the object, the element information, the encoding mode information, and the encoded data are described in the bit stream as the encoded meta data. As necessary, the prediction coefficient is also described in the bit stream.

However, in this case, not all the indexes of the objects, the element information, and the encoding mode information are described in the bit stream. More specifically, the element information and the encoding mode information about the position information or the gain in which the encoding mode is changed and the index of the object of the position information or the gain thereof are described in the bit stream, and those in which the encoding mode is not changed are not described.

As described above, in a case where the encoding mode information is described in accordance with the method of (G2), the number of pieces of encoding mode information included in the encoded meta data changes in accordance with presence/absence of a change in the encoding mode. Therefore, the mode change number information is described in the encoded meta data so that the decoding side can correctly read the encoded data from the encoded meta data.

<Example of a Configuration of Meta Data Encoder>

Subsequently, a specific embodiment of the meta data encoder 22, which is an encoding device for encoding the meta data, will be explained.

Figure 4:
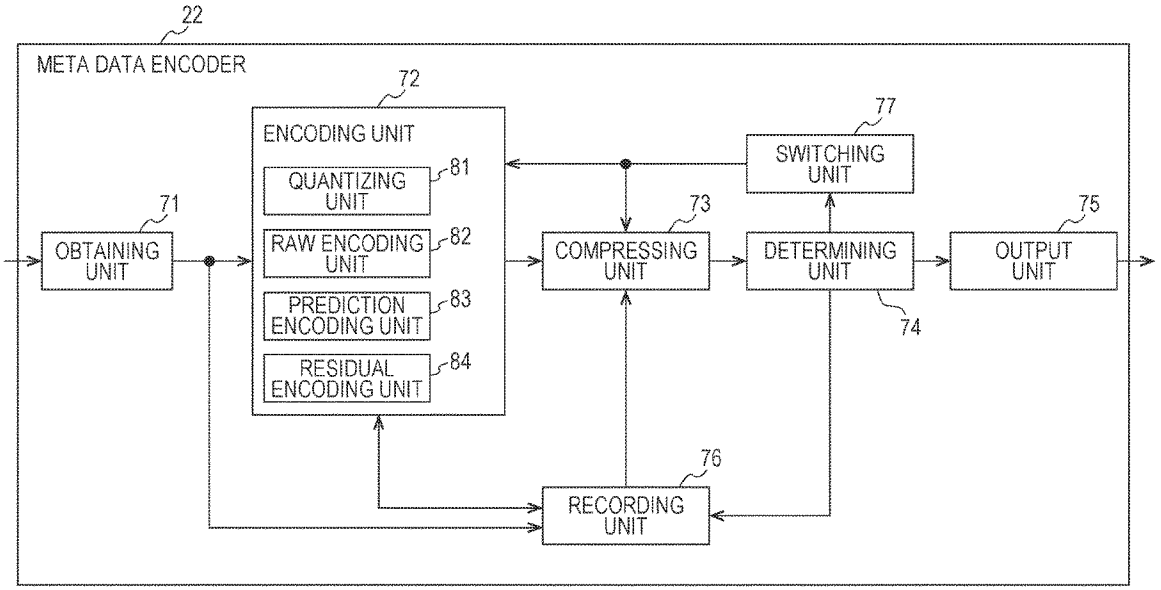
FIG. 4 is a figure illustrating an example of a configuration of a meta data encoder.

FIG. 4 is a figure illustrating an example of a configuration of the meta data encoder 22 as shown in FIG. 1.

The meta data encoder 22 as shown in FIG. 4 includes an obtaining unit 71, an encoding unit 72, a compressing unit 73, a determining unit 74, an output unit 75, a recording unit 76, and a switching unit 77.

The obtaining unit 71 obtains the meta data of the object from the space position information output device 12, and provides the meta data to the encoding unit 72 and the recording unit 76. For example, the obtaining unit 71 obtains, as the meta data, the indexes of N objects, the angles $\theta$ in the horizontal direction, the angles $\gamma$ in the vertical direction, the distances r, and the gains g for the N objects.

The encoding unit 72 encodes the meta data obtained by the obtaining unit 71, and provides the meta data to the compressing unit 73. The encoding unit 72 includes a quantizing unit 81, a RAW encoding unit 82, a prediction encoding unit 83, and a residual encoding unit 84.

As the encoding processing of the first step explained above, the quantizing unit 81 quantizes the position information and the gain of each object, and provides the position information and the gain having been quantized to the recording unit 76 to cause the recording unit 76 to record the position information and the gain having been quantized.

The RAW encoding unit 82, the prediction encoding unit 83, and the residual encoding unit 84 encode the position information and the gain of the object in each encoding mode in the encoding processing in the second step explained above.

More specifically, the RAW encoding unit 82 encodes the position information and the gain in the RAW encoding mode, the prediction encoding unit 83 encodes the position information and the gain in the motion pattern prediction mode, and the residual encoding unit 84 encodes the position information and the gain in the residual mode. During the encoding, the prediction encoding unit 83 and residual encoding unit 84 performs encoding while referring to the information about the frames in the past recorded in the recording unit 76 as necessary.

As a result of encoding of the position information and the gain, the encoding unit 72 provides the index of each object, the encoding mode information, the encoded position information, and the gain to the compressing unit 73.

The compressing unit 73 compresses the encoding mode information provided from the encoding unit 72 while referring to the information recorded in the recording unit 76.

More specifically, the compressing unit 73 selects any encoding mode for the position information and the gain of each object, and generates encoded meta data obtained when each pieces of position information and gains are encoded with the combination of encoding modes selected. The compressing unit 73 compresses the encoding mode information about the encoded meta data generated for each combination of the encoding modes different from each other, and provides the encoding mode information to the determining unit 74.

The determining unit 74 selects the encoded meta data of which amount of data is the least from among the encoded meta data obtained for each combination of encoding modes of the position information and gains provided from the compressing unit 73, thus determining the encoding mode of each pieces of position information and gains.

The determining unit 74 provides the encoding mode information indicating the determined encoding mode to the recording unit 76, and describes the selected encoded meta data in the bit stream as the final encoded meta data, and provides the bit stream to the output unit 75.

The output unit 75 outputs the bit stream provided from the determining unit 74 to the meta data decoder 32. The recording unit 76 records the information provided from the obtaining unit 71, the encoding unit 72, and the determining unit 74, so that the recording unit 76 holds each of the quantized position information and gains of the frames in the past of all the objects and the encoding mode information about the position information and gains thereof, and provides the information to the encoding unit 72 and the compressing unit 73. In addition, the recording unit 76 records the encoding mode information indicating each motion pattern prediction mode and the prediction coefficients of the motion pattern prediction modes thereof in such a manner that the encoding mode information indicating each motion pattern prediction mode and the prediction coefficients of the motion pattern prediction modes thereof are associated with each other.

Further, the encoding unit 72, the compressing unit 73, and the determining unit 74 perform processing for adopting, as a candidate of a new selected motion pattern prediction mode, a combination of several motion pattern prediction modes in order to switch the selected motion pattern prediction mode, and encode the meta data. The determining unit 74 provides, to the switching unit 77, the amount of data of the encoded meta data for a predetermined number of frames obtained with regard to each combination and the amount of data of the encoded meta data for a predetermined number of frames including the current frame which is actually output.

The switching unit 77 determines a new selected motion pattern prediction mode on the basis of the amount of data provided from the determining unit 74, and provides the determination result to the encoding unit 72 and the compressing unit 73.

<Explanation about Encoding Processing>

Subsequently, operation of the meta data encoder 22 of FIG. 4 will be explained.

In the following explanation, the step width of quantization used in the expression (1) and the expression (2) explained above, i.e., a step size R, is assumed to be 1 degrees. Therefore, in this case, the range of the angle θ in the horizontal direction after the quantization is expressed by 361 discrete values, and the value of the angle θ in the horizontal direction after the quantization is a value of nine bits. Likewise, the range of the angle γ in the vertical direction after the quantization is expressed by 181 discrete values, and the value of the angle γ in the vertical direction after the quantization is a value of eight bits.

The distance r is assumed to be quantized so that the value having been quantized is expressed with totally eight bits by using a floating decimal number including a four-bit mantissa and four-bit exponent. Further, the gain g is assumed to be, for example, a value in a range of −128 dB to +127.5 dB, and in the encoding of the first step, the gain g is assumed to be quantized into a value of nine bits with a step of 0.5 dB, and more specifically, with a step size of "0.5".

In the encoding in the residual mode, the number of bits Mused as a threshold value compared with a difference is assumed to be 1 bit.

When the meta data are provided to the meta data encoder 22, and the meta data encoder 22 is commanded to encode the meta data, the meta data encoder 22 starts encoding processing for encoding and outputting the meta data. Hereinafter, the encoding processing performed with the meta data encoder 22 will be explained with the reference to the flowchart of FIG. 5. It should be noted that this encoding processing is performed for each frame of the audio data.

In step S11, the obtaining unit 71 obtains the meta data which is output from the space position information output device 12, and provides the meta data to the encoding unit 72 and the recording unit 76. The recording unit 76 records the meta data provided from the obtaining unit 71. For example, the meta data include the indexes of N objects, the position information, and the gains.

In step S12, the encoding unit 72 selects a single object, which is to be processed, from among the N objects.

In step S13, the quantizing unit 81 quantizes the position information and the gain of the object, which are to be processed, provided from the obtaining unit 71. The quantizing unit 81 provides the quantized position information and gain to the recording unit 76, and causes the recording unit 76 to record the quantized position information and gain.

For example, the angle θ in the horizontal direction and the angle γ in the vertical direction, which serve as the position information, are quantized by the expression (1) explained above with a step of R=1 degrees. Likewise, the distance r and the gain g are also quantized.

In step S14, the RAW encoding unit 82 encodes, in the RAW encoding mode, the position information and the gain which have been quantized and are to be processed. More specifically, the position information and the gain having been quantized are made into encoded position information and gain in the RAW encoding mode as they are.

In step S15, the prediction encoding unit 83 performs encoding processing in the motion pattern prediction mode, and encodes the quantized position information and the quantized gain of the object, which is to be processed, in the motion pattern prediction mode. The details of the encoding processing in the motion pattern prediction mode will be explained later, but, in the encoding processing based on the motion pattern prediction mode, a prediction using prediction coefficients is performed in each selected motion pattern prediction mode.

In step S16, the residual encoding unit 84 performs the encoding processing in the residual mode, and encodes, in the residual mode, the quantized position information and the quantized gain of the object to be processed. It should be noted that the details of the encoding processing in the residual mode will be explained later.

In step S17, the encoding unit 72 determines whether processing is performed on all of the objects or not.

In a case where the processing is determined not to have been performed on all of the objects in step S17, the processing in step S12 is performed again, and the above processing is repeated. More specifically, a new object is selected as an object to be processed, and the encoding is performed on the position information and the gain of the object in each encoding mode.

In contrast, in a case where the processing is determined to have been performed on all of the objects in step S17, the processing in step S18 is subsequently performed. At this occasion, the encoding unit 72 provides, to the compressing unit 73, the position information and gain (encoded data) obtained from the encoding in each encoding mode, encoding mode information indicating the encoding mode of each pieces of position information and gains, and the index of the object.

In step S18, compressing unit 73 performs the encoding mode information compressing processing. The details of the encoding mode information compressing processing will be explained later, but, in the encoding mode information compressing processing, encoded meta data are generated for each combination of encoding modes on the basis of the index of the object, the encoded data, and the encoding mode information provided from the encoding unit 72.

More specifically, with regard to a single object, the compressing unit 73 selects any given encoding mode for each of the pieces of position information and the gains of the object. Likewise, with regard to all of the other objects, the compressing unit 73 selects any given encoding mode for each of the pieces of position information and the gains of each object, and adopts, as a single combination, the combination of these encoding modes having been selected.

Then, the compressing unit 73 generates encoded meta data obtained by encoding the position information and the gains in the encoding modes shown by the combination, while compressing the encoding mode information about all the combinations that could be the combinations of the encoding modes.

In step S19, the compressing unit 73 determines whether the selected motion pattern prediction mode has been switched or not in the current frame. For example, in a case where information indicating a new selected motion pattern prediction mode is provided from the switching unit 77, it is determined that there is a switching in the selected motion pattern prediction mode.

In a case where it is determined that there is a switching of the selected motion pattern prediction mode in step S19, the compressing unit 73 inserts a prediction coefficient switch flag and a prediction coefficient into the encoded meta data of each combination in step S20.

More specifically, the compressing unit 73 reads, from the recording unit 76, the prediction coefficient of the selected motion pattern prediction mode indicated by the information provided from the switching unit 77, and inserts the read prediction coefficient and the prediction coefficient switch flag indicating the switching into the encoded meta data of each combination.

When the processing in step S20 is performed, the compressing unit 73 provides, to the determining unit 74, the encoded meta data of each combination into which the prediction coefficient and the prediction coefficient switch flag are inserted, and the processing in step S21 is subsequently performed.

In contrast, in a case where it is determined that there is not any switching of the selected motion pattern prediction mode in step S19, the compressing unit 73 inserts, into the encoded meta data of each combination, a prediction coefficient switch flag indicating that there is not any switching, and provides the encoded meta data to the determining unit 74, and the processing in step S21 is subsequently performed.

In a case where the processing in step S20 is performed, or in a case where it is determined that there is not any switching in step S19, the determining unit 74 determines the encoding mode of each pieces of position information and gains on the basis of the encoded meta data of each combination provided from the compressing unit 73 in step S21.

More specifically, the determining unit 74 determines that the encoded meta data of which amount of data (the total number of bits) is the least is adopted as the final encoded meta data from among the encoded meta data of each combination, and writes the determined encoded meta data to the bit stream, and provides the bit stream to the output unit 75. Therefore, the encoding mode of the position information and the gain of each object is determined. Therefore, by selecting the encoded meta data of which amount of data is the least, the encoding mode of each pieces of position information and gains can be determined.

The determining unit 74 provides, to the recording unit 76, the encoding mode information indicating the encoding mode of each pieces of position information and gains having been determined, and causes the recording unit 76 to record the encoding mode information, and provides the amount of data of the encoded meta data of the current frame to the switching unit 77.

In step S22, the output unit 75 transmits the bit stream provided from the determining unit 74 to the meta data decoder 32, and the encoding processing is terminated.

As described above, the meta data encoder 22 encodes each element such as the position information and the gain constituting the meta data in accordance with an appropriate encoding mode, and makes the encoded meta data.

As described above, the encoding is performed by determining an appropriate encoding mode for each element, the encoding efficiency is improved and the amount of data of the encoded meta data can be reduced. As a result, during the decoding of the audio data, higher quality audio can be obtained, and the audio play back can be realized with a higher degree of presence. During the generation of the encoded meta data, the encoding mode information is compressed, so that the amount of data of the encoded meta data can be further reduced.

<Explanation about Encoding Processing in Motion Pattern Prediction Mode>

Subsequently, encoding processing in the motion pattern prediction mode corresponding to the processing in step S15 of FIG. 5 will be explained with the reference to the flowchart of FIG. 6.

It should be noted that this processing is performed for each of the pieces of position information and the gains of the object which is to be processed. More specifically, each of the angle θ in the horizontal direction, the angle γ in the vertical direction, the distance r, and the gain g of the object is adopted as the target of the processing, and the encoding processing is performed in the motion pattern prediction mode for each of the targets of the processing thereof.

In step S51, the prediction encoding unit 83 predicts the position information or the gain of the object in each motion pattern prediction mode selected as the selected motion pattern prediction mode at the present moment.

For example, suppose that the angle θ in the horizontal direction serving as the position information is encoded, and the stationary mode, the constant speed mode, and the constant acceleration mode are selected as the selected motion pattern prediction modes.

In such case, first, the prediction encoding unit 83 reads the quantized angle θ in the horizontal direction of the past frame and the prediction coefficient of the selected motion pattern prediction modes from the recording unit 76. Then, the prediction encoding unit 83 uses the angle θ in the horizontal direction and the prediction coefficient that have been read out to identify whether the angle θ in the horizontal direction can be predicted or not in the selected motion pattern prediction mode of any one of the stationary mode, the constant speed mode, and the constant acceleration mode. More specifically, a determination is made as to whether the expression (3) described above is satisfied.

Figure 5:
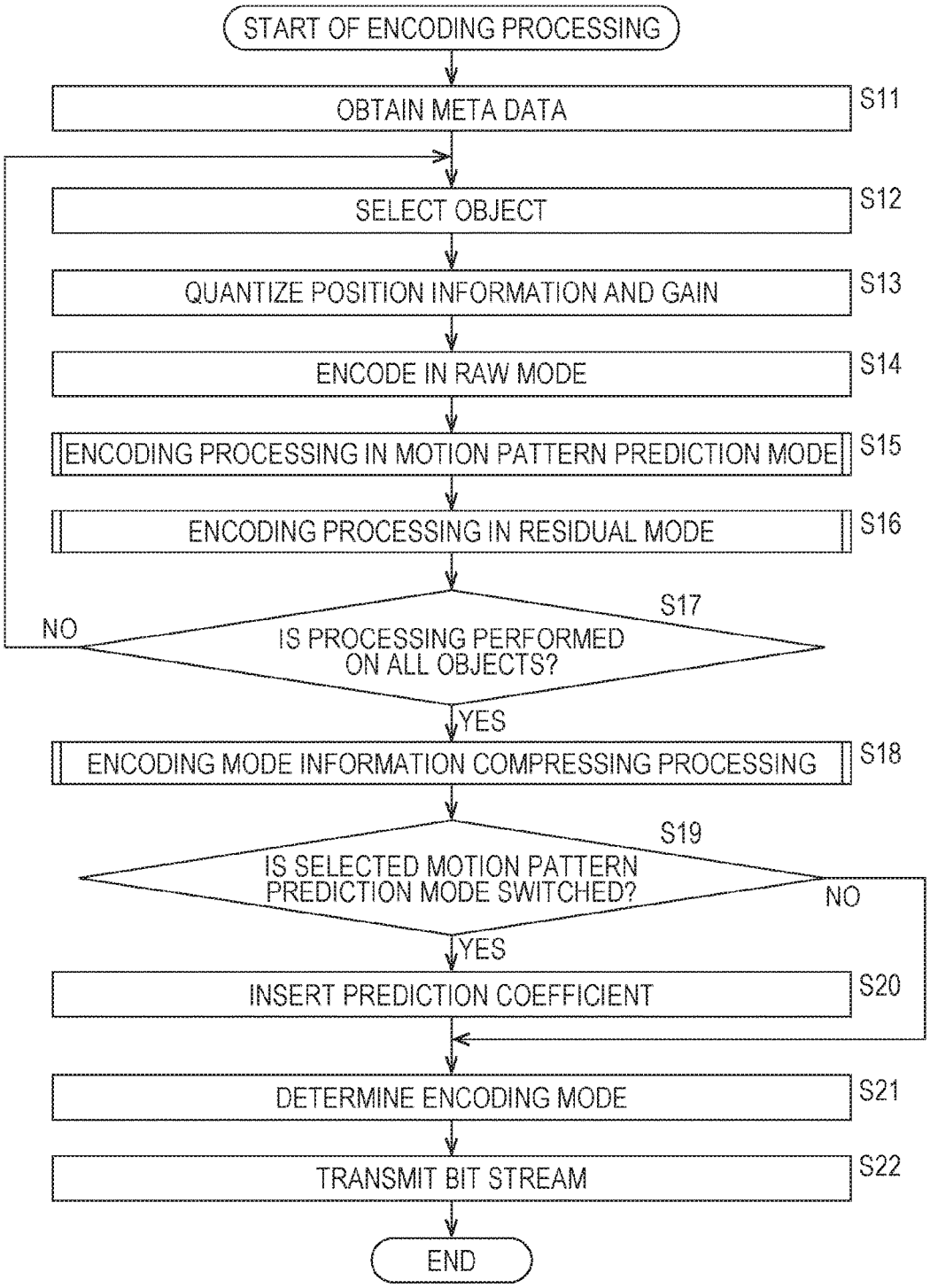
FIG. 5 is a flowchart for explaining encoding processing.
Figure 6:
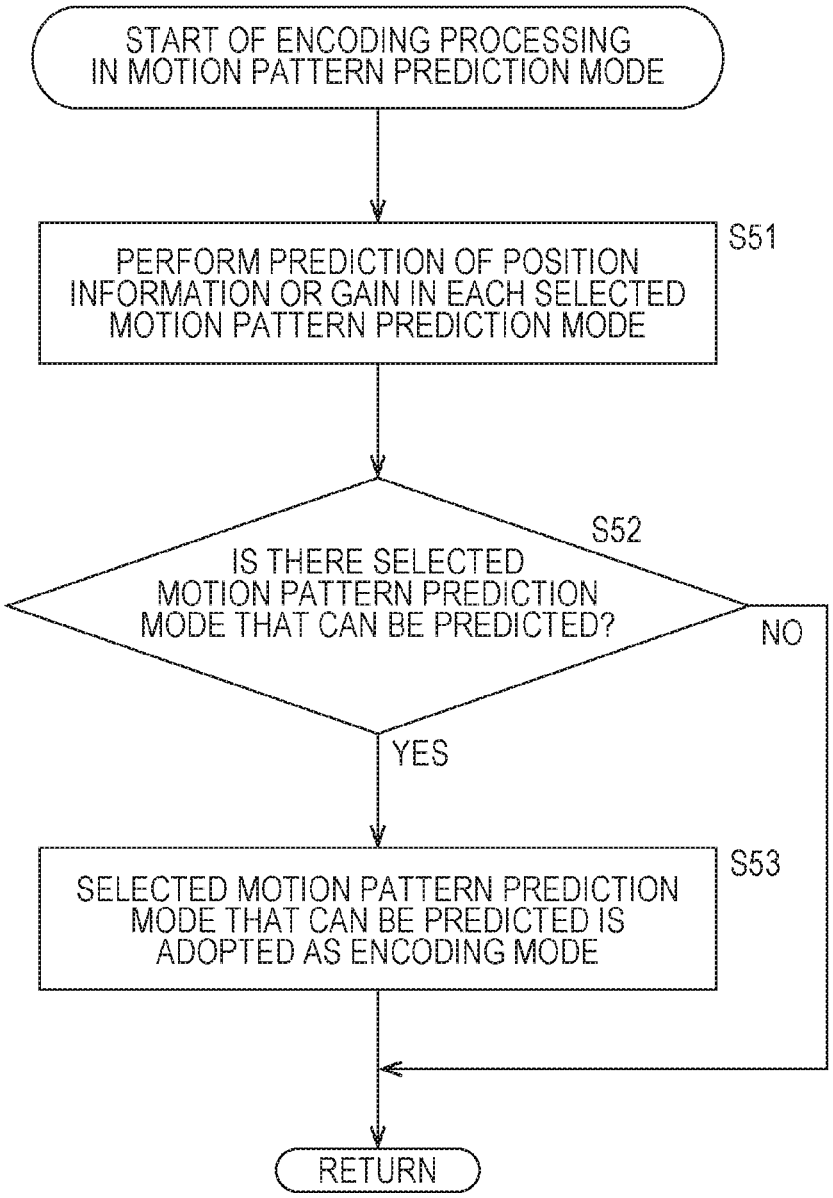
FIG. 6 is a flowchart for explaining the encoding processing in a motion pattern prediction mode.

During the calculation of the expression (3), the prediction encoding unit 83 substitutes the angle θ in the horizontal direction of the current frame quantized in the processing in step S13 of FIG. 5 and the quantized angle θ in the horizontal direction of the past frame into the expression (3).

In step S52, the prediction encoding unit 83 determines whether there is any selected motion pattern prediction mode in the selected motion pattern prediction modes in which the position information or the gain which is to be processed could be predicted.

For example, in a case where the expression (3) is determined to be satisfied when the prediction coefficient of the stationary mode serving as the selected motion pattern prediction mode is used in the processing in step S51, it is determined that the prediction could be performed in the stationary mode, and more specifically, it is determined that there is a selected motion pattern prediction mode in which the prediction could be performed.

In a case where it is determined that there is a selected motion pattern prediction mode in which the prediction could be performed in step S52, the processing in step S53 is subsequently performed.

In step S53, the prediction encoding unit 83 adopts the selected motion pattern prediction mode in which the prediction is determined to be able to be performed as the encoding mode of the position information or the gain which is to be processed, and then, the encoding processing in the motion pattern prediction mode is terminated. Then, thereafter, the processing in step S16 of FIG. 5 is subsequently performed.

In contrast, in a case where it is determined that there is not any selected motion pattern prediction mode in which the prediction could be performed in step S52, the position information or the gain which is to be processed is determined not to be able to be encoded in the motion pattern prediction mode, and the encoding processing in the motion pattern prediction mode is terminated. Then, thereafter, the processing in step S16 of FIG. 5 is subsequently performed.

In this case, when a combination of encoding modes for generating the encoded meta data is determined, the motion pattern prediction mode cannot be adopted as the encoding mode for the position information or the gain which is to be processed.

As described above, the prediction encoding unit 83 uses information about the past frames to predict the quantized position information or the quantized gain of the current frame, and in a case where the prediction is possible, only the encoding mode information about the motion pattern prediction mode that is determined to be able to be predicted is included in the encoded meta data. Therefore, the amount of data of the encoded meta data can be reduced.

<Explanation about Encoding Processing in Residual Mode>

Figure 7:
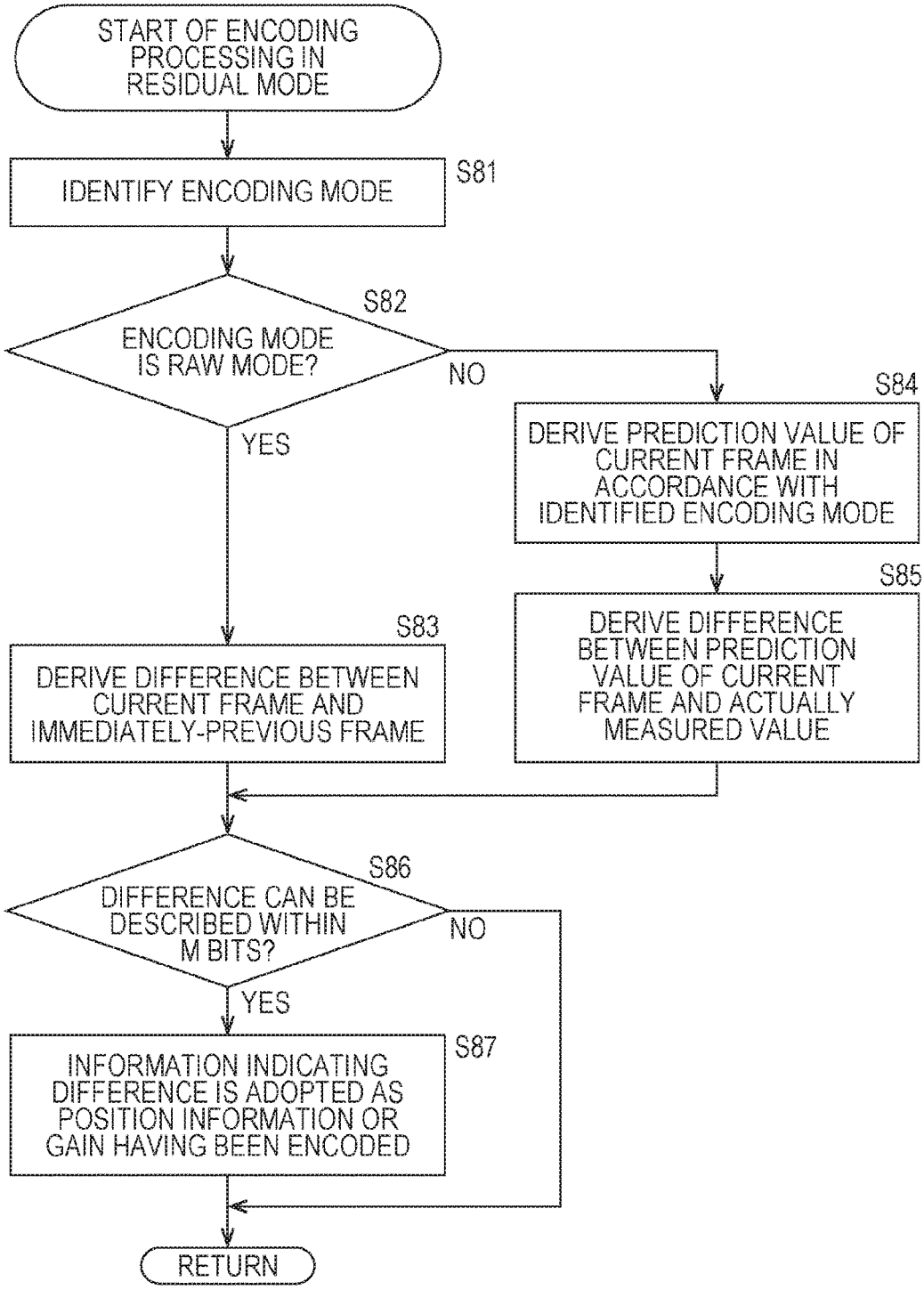
FIG. 7 is a flowchart for explaining the encoding processing in a residual mode.

Subsequently, the encoding processing in the residual mode corresponding to the processing in step S16 of FIG. 5 will be explained with the reference to the flowchart of FIG. 7. In this processing, each of the angle θ in the horizontal direction, the angle γ in the vertical direction, and the gain g which is to be processed is adopted as the target of the processing, and the processing is performed on each of the targets of the processing.

In step S81, the residual encoding unit 84 identifies the encoding mode of the immediately previous frame by referring to the encoding mode information about the past frames recorded in the recording unit 76.

More specifically, the residual encoding unit 84 identifies a frame in the past which is most close to the current frame in time and in which the encoding mode of the position information or the gain to be processed is not the residual mode, and more specifically, the residual encoding unit 84 identifies a frame in the past which is most close to the current frame in time and in which the encoding mode is the motion pattern prediction mode or the RAW mode. Then, the residual encoding unit 84 adopts, as the encoding mode of the immediately previous frame, the encoding mode of the position information or the gain, which is to be processed, in the identified frame.

In step S82, the residual encoding unit 84 determines whether the encoding mode of the immediately previous frame identified in the processing in step S81 is the RAW mode or not.

In a case where the encoding mode of the immediately previous frame identified in the processing in step S81 is determined to be the RAW mode in step S82, the residual encoding unit 84 derives the difference (residual) between the current frame and the immediately previous frame in step S83.

More specifically, the residual encoding unit 84 derives the difference between the quantized value of the position information or the gain, which is to be processed, in the immediately previous frame, i.e., one frame before the current frame, that is recorded in the recording unit 76 and the quantized value of the position information or the gain of the current frame.

At this occasion, the values of the position information or the gain of the current frame and the immediately previous frame between which the difference is derived are the values of the position information or the gain quantized by the quantizing unit 81, and more specifically, the values of the position information or the gain of the current frame and the immediately previous frame between which the difference is derived are quantized values. When the difference is derived, thereafter, the processing in step S86 is subsequently performed.

On the other hand, in a case where the encoding mode of the immediately previous frame identified in the processing in step S81 is determined not to be the RAW mode in step S82, and more specifically, the encoding mode is determined to be the motion pattern prediction mode, the residual encoding unit 84 derives, in step S84, the quantized prediction value of the position information or the gain of the current frame in accordance with the encoding mode identified in step S81.

For example, suppose that the angle θ in the horizontal direction serving as the position information is to be processed, and the encoding mode of the immediately previous frame identified in step S81 is the stationary mode. In such case, the residual encoding unit 84 predicts the quantized angle θ in the horizontal direction of the current frame by using the quantized angle θ in the horizontal direction recorded in the recording unit 76 and the prediction coefficient of the stationary mode.

More specifically, the expression (3) is calculated, and the quantized prediction value of the angle θ in the horizontal direction of the current frame is derived.

In step S85, the residual encoding unit 84 derives the difference between the quantized prediction value of the position information or the gain of the current frame and the actually measured value. More specifically, the residual encoding unit 84 derives the difference between the prediction value derived in the processing in step S84 and the quantized value of the position information or the gain, which is to be processed, of the current frame obtained in the processing in step S13 of FIG. 5.

When the difference is derived, thereafter, the processing in step S86 is subsequently performed.

When the processing in step S83 or step S85 is performed, the residual encoding unit 84 determines whether the derived difference can be described with M bits or less when expressed as a binary number in step S86. As described above, in this case, M is 1 bit, and a determination is made as to whether the difference is a value that can be described with one bit.

In a case where the difference is determined to be able to be described with M bits or less in step S86, information indicating the difference derived by the residual encoding unit 84 is adopted as the position information or the gain having been encoded in the residual mode, and more specifically, adopted as the encoded data as shown in FIG. 3 in step S87.

For example, in a case where the angle θ in the horizontal direction or the angle γ in the vertical direction serving as the position information is to be processed, the residual encoding unit 84 adopts, as the encoded position information, a flag indicating whether the code of the difference derived in step S83 or step S85 is positive or negative. This is because the number of bits M used in the processing in step S86 is one bit, and therefore, when the decoding side finds the code of the difference, the decoding side can identify the value of the difference.

When the processing in step S87 is performed, the encoding processing in the residual mode is terminated, and, hereafter, the processing in step S17 of FIG. 5 is subsequently performed.

In contrast, in a case where the difference is determined not to be able to be described with M bits or less in step S86, the position information or the gain which is to be processed cannot be encoded in the residual mode, and the encoding processing in the residual mode is terminated. Then, thereafter, the processing in step S17 of FIG. 5 is subsequently performed.

In this case, when a combination of encoding modes for generating the encoded meta data is determined, the residual mode cannot be adopted as the encoding mode for the position information or the gain which is to be processed.

As described above, the residual encoding unit 84 derives the quantized difference (residual) of the position information or the gain of the current frame in accordance with the encoding mode of the past frame, and in a case where the difference can be described with M bits, the information indicating the difference is adopted as the position information or the gain having been encoded. As described above, the information indicating the difference is adopted as the position information or the gain having been encoded, so that, as compared with the case where the position information and the gain are described as they are, the amount of data of the encoded meta data can be reduced.

<Explanation about Encoding Mode Information Compressing Processing>

Figure 8:
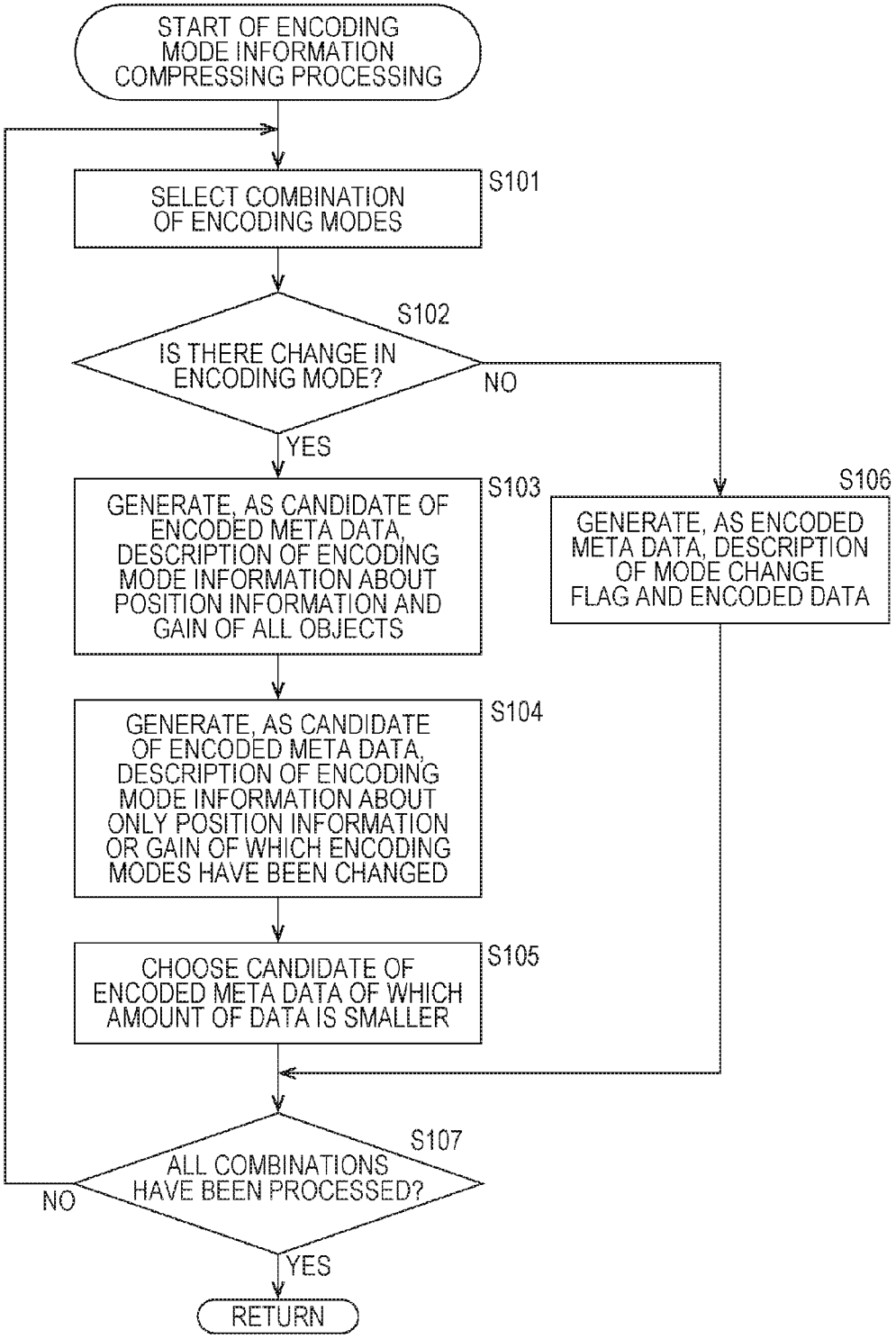
FIG. 8 is a flowchart for explaining encoding mode information compressing processing.

Further, the encoding mode information compressing processing corresponding to the processing in step S18 of FIG. 5 will be explained with the reference to the flowchart of FIG. 8.

At the point in time when this processing is started, the encoding in each encoding mode has been performed on each pieces of position information and gains of all the objects of the current frame.

In step S101, the compressing unit 73 selects a combination of encoding modes that has not yet selected as the target of the processing on the basis of the encoding mode information about each pieces of position information and gains of all the objects provided from the encoding unit 72.

More specifically, the compressing unit 73 selects the encoding mode for each pieces of position information and gain of each object, and adopts, as a combination of new targets of the processing, a combination of encoding modes thus selected.

In step S102, the compressing unit 73 determines, with regard to the combination of the targets of the processing, whether there is a change in the encoding mode of the position information and the gain of each object.

More specifically, the compressing unit 73 compares the encoding mode, which is the combination of the targets of the processing, of each pieces of position information and gains of all the objects and the encoding mode of each pieces of position information and gains of all the objects of the immediately previous frame indicated by the encoding mode information recorded by the recording unit 76. Then, in a case where the encoding mode is different between the current frame and the immediately previous frame even in a single position information or gain, the compressing unit 73 determines that there is a change in the encoding mode.

In a case where it is determined that there is a change in step S102, the compressing unit 73 generates, as a candidate of encoded meta data, a description of encoding mode information about the position information and the gain of all the objects in step S103.

More specifically, the compressing unit 73 generates, as a candidate of encoded meta data, a single data including a mode change flag, a mode list mode flag, encoding mode information indicating a combination of encoding modes of targets of the processing of all the position information and the gain, and the encoded data.

In this case, the mode change flag is a value indicating that there is a change in the encoding mode, and the mode list mode flag is a value indicating that the encoding mode information about all the pieces of position information and gains is described. The encoded data included in a candidate of the encoded meta data are data corresponding to the encoding mode, which is the combination of the targets of the processing, of each pieces of position information and gains in the encoded data provided from the encoding unit 72.

It should be noted that the prediction coefficient switch flag and the prediction coefficient have not yet been inserted into the encoded meta data obtained in step S103.

In step S104, the compressing unit 73 generates, as a candidate of encoded meta data, a description of encoding mode information about only the position information or the gain of which encoding modes have been changed, which are chosen from among the position information and the gain of the objects.

More specifically, the compressing unit 73 generates, as a candidate of the encoded meta data, a single data made up with the mode change flag, the mode list mode flag, the mode change number information, the index of the object, the element information, the encoding mode information, and the encoded data.

In this case, the mode change flag is a value indicating that there is a change in the encoding mode, and the mode list mode flag is a value indicating that the encoding mode information of only the position information or the gain in which there is a change in the encoding mode is described.

The index of the object describes only the index indicating the object having the position information or the gain in which there is a change in the encoding mode, and the element information and encoding mode information also describes only the position information or the gain in which there is a change in the encoding mode. Further, the encoded data included in a candidate of the encoded meta data are data corresponding to the encoding mode, which is the combination of the targets of the processing, of each pieces of position information and gains in the encoded data provided from the encoding unit 72.

Like the case of step S103, in the encoded meta data obtained in step S104, the prediction coefficient switch flag and the prediction coefficient have not yet been inserted into the encoded meta data.

In step S105, the compressing unit 73 compares the amount of data of the candidate of the encoded meta data generated in step S103 and the amount of data of the candidate of the encoded meta data generated in step S104, and selects any one of the amount of data of the candidate of the encoded meta data generated in step S103 and the amount of data of the candidate of the encoded meta data generated in step S104 whichever the amount of data is smaller. Then, the compressing unit 73 adopts the selected candidate of the encoded meta data as the encoded meta data of the combination of the encoding modes which are to be processed, and the processing in step S107 is subsequently performed.

In a case where it is determined that there is not any change in the encoding mode in step S102, the compressing unit 73 generates, as encoded meta data, a description of mode change flag and encoded data in step S106.

More specifically, the compressing unit 73 generates, as the encoded meta data of the combination of encoding modes which are to be processed, a single data made up with the mode change flag indicating that there is no change in the encoding mode and the encoded data.

In this case, the encoded data included in the encoded meta data are data corresponding to the encoding mode, which is the combination of the targets of the processing, of each pieces of position information and gains in the encoded data provided from the encoding unit 72. It should be noted that the prediction coefficient switch flag and the prediction coefficient have not yet been inserted into the encoded meta data obtained in step S106.

When the encoded meta data are generated in step S106, thereafter, the processing in step S107 is subsequently performed.

When the encoded meta data for the combination of the targets of the processing are obtained in step S105 or in step S106, the compressing unit 73 determines whether the processing has been performed for all the combinations of the encoding modes in step S107. More specifically, a determination is made as to whether the combinations of all the encoding modes that can be the combinations have been adopted as the targets of the processing, and whether the encoded meta data have been generated or not.

In a case where the processing is determined not to have been performed for all the combinations of the encoding modes in step S107, the processing in step S101 is performed again, and the processing explained above is repeated. More specifically, a new combination is adopted as the target of the processing, and encoded meta data are generated for the combination.

In contrast, in a case where the processing is determined to have been performed for all the combinations of the encoding modes step S107, the encoding mode information compressing processing is terminated. When the encoding mode information compressing processing is terminated, thereafter, the processing in step S19 of FIG. 5 is subsequently performed.

As described above, the compressing unit 73 generates the encoded meta data in accordance with presence/absence of the change of the encoding mode for all the combinations of the encoding modes. By generating the encoded meta data in accordance with presence/absence of the change of the encoding mode in this manner, the encoded meta data including only necessary information can be obtained, and the amount of data of the encoded meta data can be compressed.

In this embodiment, an example for determining the encoding mode of each pieces of position information and gains by generating the encoded meta data for each combination of the encoding modes and thereafter selecting the encoded meta data of which amount of data is the least in step S21 of the encoding processing as shown in FIG. 5 has been explained. Alternatively, the compressing of the encoding mode information may be performed after the encoding mode of each pieces of position information and gains is determined.

In such case, first, after the position information and the gain have been encoded in each encoding mode, the encoding mode in which the amount of data of the encoded data becomes the least is determined for each of the pieces of position information and gains. Then, the processing in step S102 to step S106 of FIG. 8 is performed for the combination of the determined encoding mode of each pieces of position information and gains, whereby the encoded meta data are generated.

<Explanation about Switching Processing>

By the way, while the encoding processing explained with reference to FIG. 5 is repeatedly performed by the meta data encoder 22, the switching processing for switching the selected motion pattern prediction mode is performed immediately after the encoding processing for one frame is performed or substantially at the same time as the encoding processing.

Figure 9:
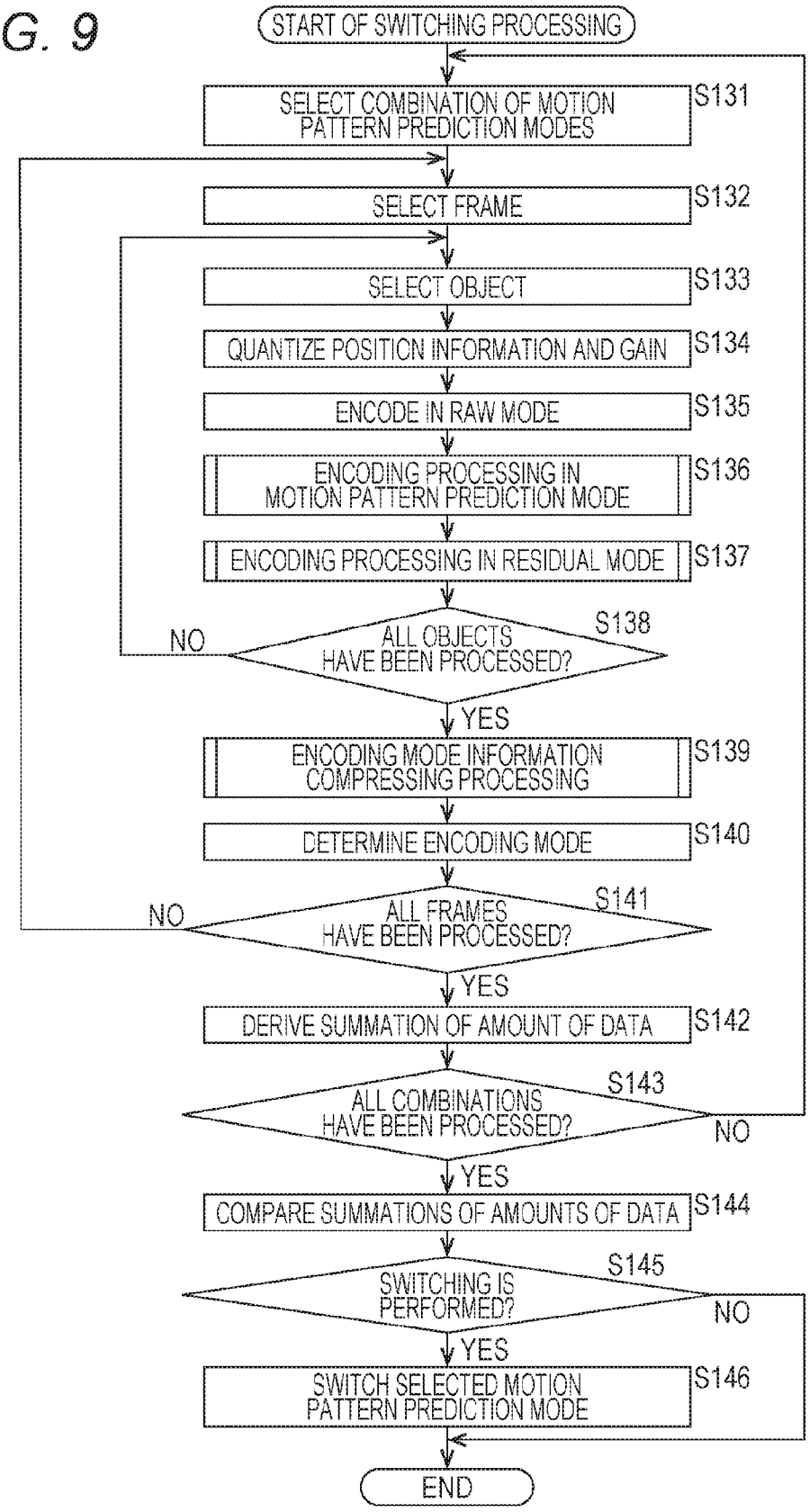
FIG. 9 is a flowchart for explaining switching processing.

Hereinafter, the switching processing performed by the meta data encoder 22 will be explained with reference to the flowchart of FIG. 9.

In step S131, the switching unit 77 selects a combination of motion pattern prediction modes, and provides the selection result to the encoding unit 72. More specifically, the switching unit 77 selects, as a combination of motion pattern prediction modes, any given three motion pattern prediction modes of all the motion pattern prediction modes.

At the present moment, the switching unit 77 holds information about three motion pattern prediction modes adopted as the selected motion pattern prediction modes, and does not select a combination of selected motion pattern prediction modes at the present moment in step S131.

In step S132, the switching unit 77 selects a frame which is to be processed, and provides the selection result to the encoding unit 72.

For example, a predetermined number of continuous frames including the current frame of the audio data and the past frames which are older than the current frame are selected as the frame to be processed in the ascending order of the time. In this case, the number of continuous frames which are to be processed is, for example, 10 frames.

When the frames to be processed are selected in step S132, thereafter, the processing in step S133 to step S140 is performed on the frames to be processed. The processing in step S133 to step S140 is the same as the processing in step S12 to step S18 and step S21 of FIG. 5, and therefore, explanation thereabout is omitted.

However, in step S134, the position information and the gain of the past frame recorded in the recording unit 76 may be quantized, or the quantized position information and the quantized gain of the past frame recorded in the recording unit 76 may be used as they are.

In step S136, the encoding processing in the motion pattern prediction mode is performed while the combination of the motion pattern prediction modes selected in step S131 is the selected motion pattern prediction modes. Therefore, the motion pattern prediction modes of the combination which are to be processed are used for any of the pieces of position information and gains, and the position information and the gain are predicted.

Further, the encoding mode of the past frame used in the processing in step S137 is the encoding mode obtained in the processing in step S140 for the past frame. In step S139, the encoded meta data are generated so that the encoded meta data include a prediction coefficient switch flag indicating that the selected motion pattern prediction mode is not switched.

According to the above processing, the encoded meta data in the case where the combination of the motion pattern prediction modes selected in step S131 with regard to the frame to be processed is assumed to be the selected motion pattern prediction mode are obtained.

In step S141, the switching unit 77 determines whether the processing is performed on all the frames or not. For example, in a case where the encoded meta data are generated when all the predetermined number of continuous frames including the current frame are selected as the frames to be processed, the processing is determined to be performed on all the frames.

In the case where the processing is determined not to have been performed on all the frames in step S141, the processing in step S132 is performed again, and the processing explained above is repeated. More specifically, a new frame is adopted as the frame to be processed, and the encoded meta data are generated for the frame.

In contrast, in the case where the processing is determined to have been performed on all the frames in step S141, the switching unit 77 derives, as the summation of the amounts of data, the total number of bits of the encoded meta data of the predetermined number of frames to be processed in step S142.

More specifically, the switching unit 77 obtains the encoded meta data of each of the predetermined number of frames, which are to be processed, from the determining unit 74, and derives the summation of the amounts of data of the encoded meta data thereof. Therefore, the summation of the amount of data of the encoded meta data that would be obtained if the combination of the motion pattern prediction modes selected in step S131 is the selected motion pattern prediction mode in the predetermined number of continuous frames can be obtained.

In step S143, the switching unit 77 determines whether the processing is performed on all the combinations of the motion pattern prediction modes. In a case where the processing is determined not to have been performed on all the combinations in step S143, the processing in step S131 is performed again, and the processing explained above is repeatedly performed. More specifically, the summation of amounts of data of the encoded meta data is calculated for the new combination.

In contrast, in a case where the processing is determined to have been performed on all the combinations in step S143, the switching unit 77 compares the summation of the amounts of data of the encoded meta data in step S144.

More specifically, the switching unit 77 selects the combination in which the summation of the amounts of data of the encoded meta data (the total number of bits) is the least from among the combinations of the motion pattern prediction modes. Then, the switching unit 77 compares the summation of the amounts of data of the encoded meta data in the selected combination and the summation of the actual amounts of data of the encoded meta data in the predetermined number of continuous frames.

In step S21 of FIG. 5 explained above, the amount of data of the encoded meta data that have been actually output is provided from the determining unit 74 to the switching unit 77, and therefore, the switching unit 77 derives the summation of the amounts of data of the encoded meta data in each frame, so that the summation of the actual amount of data can be obtained.

In step S145, the switching unit 77 determines whether the selected motion pattern prediction mode is switched or not on the basis of the comparison result of the summations of the amounts of data of the encoded meta data obtained in the processing in step S144.

For example, if the combination of the motion pattern prediction modes in which the summation of the amounts of data is the least is adopted as the selected motion pattern prediction mode in the predetermined number of past frames, the switching is determined to be performed in a case where the amount of data can be reduced by a number of bits for a predetermined A % or more.

More specifically, the difference between the summation of the amounts of data of the encoded meta data of the combination of the motion pattern prediction modes obtained as a result of the comparison performed in the processing in step S144 and the summation of the actual amounts of data of the encoded meta data is assumed to be DF bits.

In this case, when the number of bits DF of the difference of the summations of the amounts of data is equal to or more than the number of bits for A % of the summation of the actual amounts of data of the encoded meta data, it is determined that the selected motion pattern prediction mode is switched.

In a case where the switching is determined to be performed in step S145, the switching unit 77 switches the selected motion pattern prediction mode in step S146, and the switching processing is terminated.

More specifically, the switching unit 77 adopts, as the new selected motion pattern prediction mode, the motion pattern prediction modes of the combination in which the summation of the amounts of data of the encoded meta data is the least from among the combinations compared with the summation of the actual amounts of data of the encoded meta data in step S144, i.e., from among the combinations adopted as the targets of the processing. Then, the switching unit 77 provides the information indicating the new selected motion pattern prediction mode to the encoding unit 72 and compressing unit 73.

The encoding unit 72 uses the selected motion pattern prediction mode indicated by the information provided from the switching unit 77 to perform the encoding processing, which was explained with reference to FIG. 5, on a subsequent frame.

In a case where the switching is determined not to be performed in step S145, the switching processing is terminated. In this case, the selected motion pattern prediction mode at the present moment is used as the selected motion pattern prediction mode of the subsequent frame as it is.

As described above, the meta data encoder 22 generates the encoded meta data for a predetermined number of frames with regard to the combination of the motion pattern prediction modes, and compares the encoded meta data and the actual amount of data of the encoded meta data, and accordingly, the selected motion pattern prediction mode is switched. Therefore, the amount of data of the encoded meta data can be further reduced.

<Example of Configuration of Meta Data Decoder>

Subsequently, the meta data decoder 32 which is a decoding device for receiving the bit stream which is output from the meta data encoder 22 and decoding the encoded meta data will be explained.

Figure 10:
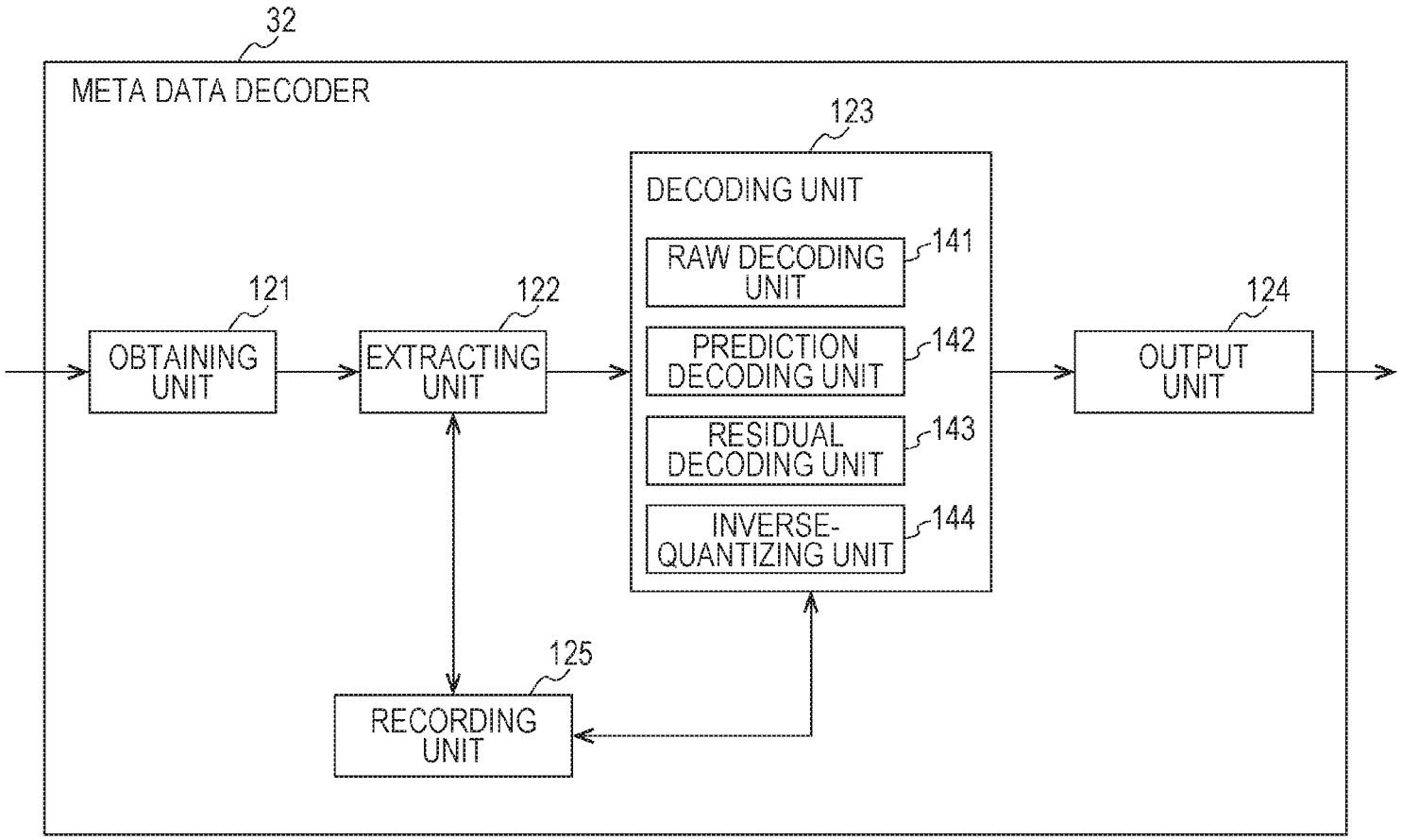
FIG. 10 is a figure illustrating an example of a configuration of a meta data decoder.

The meta data decoder 32 as shown in FIG. 1 is configured, for example, as shown in FIG. 10.

The meta data decoder 32 includes an obtaining unit 121, extracting unit 122, a decoding unit 123, an output unit 124, and a recording unit 125.

The obtaining unit 121 obtains the bit stream from the meta data encoder 22, and provides the bit stream to the extracting unit 122. The extracting unit 122 extracts the index of the object, the encoding mode information, the encoded data, the prediction coefficient, and the like from the bit stream provided from the obtaining unit 121 while referring to the information provided to the recording unit 125, and provides the index of the object, the encoding mode information, the encoded data, the prediction coefficient, and the like thus extracted to the decoding unit 123. The extracting unit 122 provides, to the recording unit 125, the encoding mode information indicating the encoding mode of each pieces of position information and gains of all the objects of the current frame, and causes the recording unit 125 to record the encoding mode information.

The decoding unit 123 decodes the encoded meta data on the basis of the encoding mode information, the encoded data, and the prediction coefficient provided from the extracting unit 122 while referring to the information recorded in the recording unit 125. The decoding unit 123 includes a RAW decoding unit 141, a prediction decoding unit 142, a residual decoding unit 143, and an inverse-quantizing unit 144.

The RAW decoding unit 141 decodes the position information and the gain in accordance with the method corresponding to the RAW mode serving as the encoding mode (which may also be hereinafter simply referred to as a RAW mode). The prediction decoding unit 142 decodes the position information and the gain in accordance with the method corresponding to the motion pattern prediction mode serving as the encoding mode (which may also be hereinafter simply referred to as motion pattern prediction mode).

The residual decoding unit 143 decodes the position information and the gain in accordance with the method corresponding to the residual mode serving as the encoding mode (which may also be hereinafter simply referred to as residual mode).

The inverse-quantizing unit 144 inversely quantizes the position information and the gain decoded in any one of the modes (methods) of the RAW mode, the motion pattern prediction mode, and the residual mode.

The decoding unit 123 provides the position information and the gain decoded in a mode such as the RAW mode, and more specifically, the decoding unit 123 provides the quantized position information and the quantized gain to the recording unit 125 and causes the recording unit 125 to record the quantized position information and the quantized gain. The decoding unit 123 provides, as the decoded meta data, the position information and the gain decoded (inversely quantized) and the index of the object provided from the extracting unit 122 to the output unit 124.

The output unit 124 outputs the meta data provided from the decoding unit 123 to the play back device 15. The recording unit 125 records each index of the object, the encoding mode information provided from the extracting unit 122, and the quantized position information and the quantized gain provided from the decoding unit 123.

<Explanation about Decoding Processing>

Subsequently, operation of the meta data decoder 32 will be explained.

When the bit stream is transmitted from the meta data encoder 22, the meta data decoder 32 receives the bit stream and starts decoding processing for decoding the meta data. Hereinafter, the decoding processing performed by the meta data decoder 32 will be explained with reference to the flowchart of FIG. 11. It should be noted that this decoding processing is performed on each frame of the audio data.

In step S171, the obtaining unit 121 receives the bit stream transmitted from the meta data encoder 22, and provides the bit stream to the extracting unit 122.

In step S172, the extracting unit 122 determines whether there is a change in the encoding mode between the current frame and the immediately previous frame on the basis of the bit stream provided from the obtaining unit 121, i.e., the mode change flag of the encoded meta data.

In a case where it is determined that there not any change in the encoding mode in step S172, the processing in step S173 is subsequently performed.

In step S173, the extracting unit 122 obtains, from the recording unit 125, all the indexes of the objects and the encoding mode information about each pieces of position information and gains of all the objects in the frame immediately before the current frame.

Then, the extracting unit 122 provides the indexes of the objects and encoding mode information thus obtained to the decoding unit 123, and extracts the encoded data from the encoded meta data provided from the obtaining unit 121, and provides the encoded data to the decoding unit 123.

In a case where the processing in step S173 is performed, the encoding mode is the same between the current frame and the immediately previous frame in each pieces of position information and gains of all the objects, and the encoding mode information is not described in the encoded meta data. Therefore, the information about the encoding mode of the immediately previous frame provided from the recording unit 125 is used as the encoding mode information about the current frame as it is.

The extracting unit 122 provides, to the recording unit 125, the encoding mode information indicating the encoding mode of each pieces of position information and gains of the objects in the current frame, and causes the recording unit 125 to record the encoding mode information.

When the processing in step S173 is performed, thereafter, the processing in step S178 is subsequently performed.

In a case where it is determined that there is a change in the encoding mode in step S172, the processing in step S174 is subsequently performed.

In step S174, the extracting unit 122 determines whether the encoding mode information of all the position information and the gains of the objects is described in the bit stream provided from the obtaining unit 121, i.e., the encoded meta data. For example, in a case where the mode list mode flag included in the encoded meta data is a value indicating that the encoding mode information about all the pieces of position information and gains is described, the extracting unit 122 determines that the encoding information is described.

In a case where the encoding mode information about all the pieces of position information and gains of the object are determined to be described in step S174, the processing in step S175 is performed.

In step S175, the extracting unit 122 reads the indexes of the objects from the recording unit 125 and extracts the encoding mode information about each pieces of position information and gains of all the objects from the encoded meta data provided from the obtaining unit 121.

Then, the extracting unit 122 provides all the indexes of the objects and the encoding mode information about each pieces of position information and gains of the objects to the decoding unit 123, and extracts the encoded data from the encoded meta data provided from the obtaining unit 121 and provides the encoded data to the decoding unit 123. The extracting unit 122 provides the encoding mode information about each pieces of position information and gains of the objects in the current frame to the recording unit 125 and causes the recording unit 125 to record the encoding mode information.

When the processing in step S175 is performed, thereafter, the processing in step S178 is subsequently performed.

In a case where the encoding mode information about all the pieces of position information and gains of the object are determined not to be described in step S174, the processing in step S176 is performed.

In step S176, the extracting unit 122 extracts the encoding mode information in which the encoding modes have been changed from the encoded meta data, on the basis of the bit stream provided from the obtaining unit 121, i.e., the mode change number information described in the encoded meta data. In other words, all the encoding mode information included in the encoded meta data is readout. At this occasion, the extracting unit 122 also extracts the indexes of the objects from the encoded meta data.

In step S177, the extracting unit 122 obtains, from the recording unit 125, the encoding mode information about the position information and gains in which the encoding modes have not been changed and the indexes of the objects on the basis of the extraction result of step S176. More specifically, the encoding mode information of the immediately previous frame information about the position information and the gains in which the encoding modes have not been changed are read as the encoding mode information about the current frame.

Therefore, the encoding mode information about each pieces of position information and gains of all the objects in the current frame has been obtained.

The extracting unit 122 provides all the indexes of the objects in the current frame and the encoding mode information about each pieces of position information and gains to the decoding unit 123, extracts the encoded data from the encoded meta data provided from the obtaining unit 121, and provides the encoded data to the decoding unit 123. The extracting unit 122 provides the encoding mode information about each pieces of position information and gains of the objects in the current frame to the recording unit 125 and causes the recording unit 125 to record the encoding mode information.

When the processing in step S177 is performed, thereafter, the processing in step S178 is subsequently performed.

When the processing in step S173, step S175, or step S177 is performed, the extracting unit 122 determines whether the selected motion pattern prediction mode has been switched or not on the basis of the prediction coefficient switch flag of the encoded meta data provided from the obtaining unit 121 in step S178.

In a case where the switching is determined to have been performed in step S178, the extracting unit 122 extracts the prediction coefficient of new selected motion pattern prediction mode from the encoded meta data, and provides the prediction coefficient to the decoding unit 123. When the prediction coefficient is extracted, thereafter, the processing in step S180 is subsequently performed.

In contrast, in a case where the selected motion pattern prediction mode is determined not to have been switched in step S178, the processing in step S180 is subsequently performed.

In a case where the processing in step S179 is performed or the switching is determined not to have been performed in step S178, the decoding unit 123 selects, as an object to be processed, a single object from among all the objects in step S180.

In step S181, the decoding unit 123 selects the position information or the gain of the object which is to be processed. More specifically, with regard to the object to be processed, any one of the angle θ in the horizontal direction, the angle γ in the vertical direction, the distance r, and the gain g is adopted as the target of the processing.

In step S182, the decoding unit 123 determines whether the encoding mode of the position information or the gain, which is to be processed, is the RAW mode or not, on the basis of the encoding mode information provided from the extracting unit 122.

In a case where the encoding mode is determined to be the RAW mode in step S182, the RAW decoding unit 141 decodes the position information or the gain, which is to be processed, in the RAW mode in step S183.

More specifically, the RAW decoding unit 141 adopts, as the position information or the gain decoded in the RAW mode as it is, the code serving as the encoded data of the position information or the gain, which is to be processed, provided from the extracting unit 122. In this case, the position information or the gain decoded in the RAW mode is the position information or the gain obtained by being quantized in step S13 of FIG. 5.

When the decoding is performed in the RAW mode, the RAW decoding unit 141 provides the position information or the gain thus obtained to the recording unit 125, and causes the recording unit 125 to record the position information or the gain as the quantized position information or the quantized gain of the current frame, and thereafter, the processing in step S187 is subsequently performed.

In a case where it is determined that the decoding is not performed in the RAW mode in step S182, the decoding unit 123 determines whether the encoding mode of the position information or the gain which is to be processed is the motion pattern prediction mode or not, on the basis of the encoding mode information provided from the extracting unit 122 in step S184.

In a case where the encoding mode is determined to be the motion pattern prediction mode in step S184, the prediction decoding unit 142 decodes the position information or the gain, which is to be processed, in the motion pattern prediction mode in step S185.

More specifically, the prediction decoding unit 142 calculates the quantizedposition information or the quantized gain of the current frame by using the prediction coefficient of the motion pattern prediction mode indicated by the encoding mode information about the position information or the gain which is to be processed.

The expression (3) explained above and calculations similar to the expression (3) are performed to calculate the quantized position information or the quantized gain. For example, in a case where the position information to be processed is the angle θ in the horizontal direction, and the motion pattern prediction mode indicated by the encoding mode information of the angle θ in the horizontal direction is the stationary mode, the expression (3) is calculated with the prediction coefficient of the stationary mode. Then, code $Code_{arc}$ (n) obtained as a result is adopted as the angle θ in the horizontal direction of the current frame having been quantized.

It should be noted that the prediction coefficient held in advance or the prediction coefficient provided from the extracting unit 122 in accordance with the switching of the selected motion pattern prediction mode is used as the prediction coefficient used for calculating the quantized position information or the quantized gain. The prediction decoding unit 142 reads, from the recording unit 125, the quantized position information or the quantized gain of the past frame used for calculating the quantized position information or the quantized gain, and performs prediction.

When the processing in step S185 is performed, the prediction decoding unit 142 provides the position information or the gain thus obtained to the recording unit 125, and causes the recording unit 125 to record the position information or the gain as the quantized position information or the quantized gain of the current frame, and, thereafter, the processing in step S187 is subsequently performed.

In a case where the encoding mode of the position information or the gain to be processed is determined not to be the motion pattern prediction mode in step S184, and more specifically, in a case where the encoding mode of the position information or the gain to be processed is determined to be the residual mode, the processing in step S186 is performed.

In step S186, the residual decoding unit 143 decodes the position information or the gain to be processed in the residual mode.

More specifically, the residual decoding unit 143 identifies a frame in the past which is most close to the current frame in time and in which the encoding mode of the position information or the gain to be processed is not the residual mode on the basis of the encoding mode information recorded in the recording unit 125. Therefore, the encoding mode of the position information or the gain, which is to be processed, of the identified frame is any one of the motion pattern prediction mode and the RAW mode.

In a case where the encoding mode of the position information or the gain, which is to be processed, in the identified frame is the motion pattern prediction mode, the residual decoding unit 143 uses the prediction coefficient of the motion pattern prediction mode to predict the quantized position information or the quantized gain, which is to be processed, of the current frame. In this prediction, the expression (3) explained above and calculations corresponding to the expression (3) are performed by using the quantized position information or the quantized gains in the past frames recorded in the recording unit 125.

Then, the residual decoding unit 143 adds the difference indicated by the information indicating the difference serving as the encoded data of the position information or the gain, which is to be processed, provided from the extracting unit 122 to the quantized position information or the quantized gain, which is to be processed, in the current frame obtained from the prediction. Therefore, with regard to the position information or the gain which is to be processed, the quantized position information or the quantized gain of the current frame is obtained.

On the other hand, in a case where the encoding mode of the position information or the gain, which is to be processed, in the identified frame is the RAW mode, the residual decoding unit 143 obtains, from the recording unit 125, the quantized position information or the quantized gain for the position information or the gain, which is to be processed, in the frame immediately before the current frame. Then, the residual decoding unit 143 adds the difference indicated by the information indicating the difference serving as the encoded data of the position information or the gain, which is to be processed, provided from the extracting unit 122 to the quantized position information or the quantized gain having been obtained. Therefore, with regard to the position information or the gain which is to be processed, the quantized position information or the quantized gain of the current frame is obtained.

When the processing in step S186 is performed, the residual decoding unit 143 provides the position information or the gain having been obtained to the recording unit 125, and causes the recording unit 125 to record the position information or the gain as the quantized position information or the quantized gain of the current frame, and thereafter, the processing in step S187 is subsequently performed.

According to the above processing, with regard to the position information or the gain which is to be processed, the quantized position information or the quantized gain that can be obtained in the processing in step S13 of FIG. 5 can be obtained.

When the processing in step S183, step S185, or step S186 is performed, the inverse-quantizing unit 144 inversely quantizes, in step S187, the position information or the gain obtained in the processing in step S183, step S185, or step S186.

For example, in a case where the angle θ in the horizontal direction serving as the position information is adopted as the target of processing, the inverse-quantizing unit 144 calculates the expression (2) explained above to inversely quantizes, i.e., decodes, the angle θ in the horizontal direction which is to be processed.

In step S188, the decoding unit 123 determines whether all the pieces of position information and gains of the object selected as the target of the processing in the processing in step S180 have been decoded or not.

In a case where all the pieces of position information and gains are determined not to have been decoded yet in step S188, the processing in step S181 is performed again, and the processing explained above is repeated.

In contrast, in a case where all the pieces of position information and gains are determined to have been decoded in step S188, the decoding unit 123 determines whether all the objects have been processed or not in step S189.

In step S189, in a case where all the objects are determined not to have been processed yet, the processing in step S180 is performed again, and the processing explained above is repeated.

On the other hand, in a case where all the objects are determined to have been processed in step S189, each pieces of decoded position information and gains have been obtained for all the objects in the current frame.

In this case, the decoding unit 123 provides the data including all the indexes of the objects, the position information, and the gains of the current frame to the output unit 124 as the decoded meta data, and the processing in step S190 is subsequently performed.

In step S190, the output unit 124 outputs the meta data provided from the decoding unit 123 to the play back device 15, and the decoding processing is terminated.

As described above, the meta data decoder 32 identifies the encoding mode of each pieces of position information and gains on the basis of the information included in the received encoded meta data, and decodes the position information and the gains in accordance with the identified result.

In this manner, the decoding side identifies the encoding modes of each pieces of position information and the gains, and decodes the position information and the gains, so that the amount of data of the encoded meta data exchanged between the meta data encoder 22 and the meta data decoder 32 can be reduced. As a result, during the decoding of the audio data, higher quality audio can be obtained, and the audio play back can be realized with a higher degree of presence.

In addition, the decoding side identifies the encoding modes of each of the pieces of position information and gains on the basis of the mode change flag and the mode list mode flag included in the encoded meta data, so that the amount of data of the encoded meta data can be further reduced.

Second Embodiment

<Example of Configuration of Meta Data Encoder>

In the above explanation, the case where quantize the number of bits determined by the step size R of the quantization and the number of bits M used as the threshold value for comparison with the difference are determined in advance has been explained. However, these numbers of bits may be dynamically changed in accordance with the position and the gain of the object, the feature of the audio data, the bit rate of the bit stream including the information about the encoded meta data and the audio data.

For example, the degree of importance of the position information and the gain of the object may be calculated from the audio data, and in accordance with the degree of importance, the compression rate of the position information and the gain may be dynamically adjusted. In accordance with the magnitude of the bit rate of the bit stream including the information about the encoded meta data and the audio data, the compression rate of the position information and the gain may be dynamically adjusted.

Figure 12:
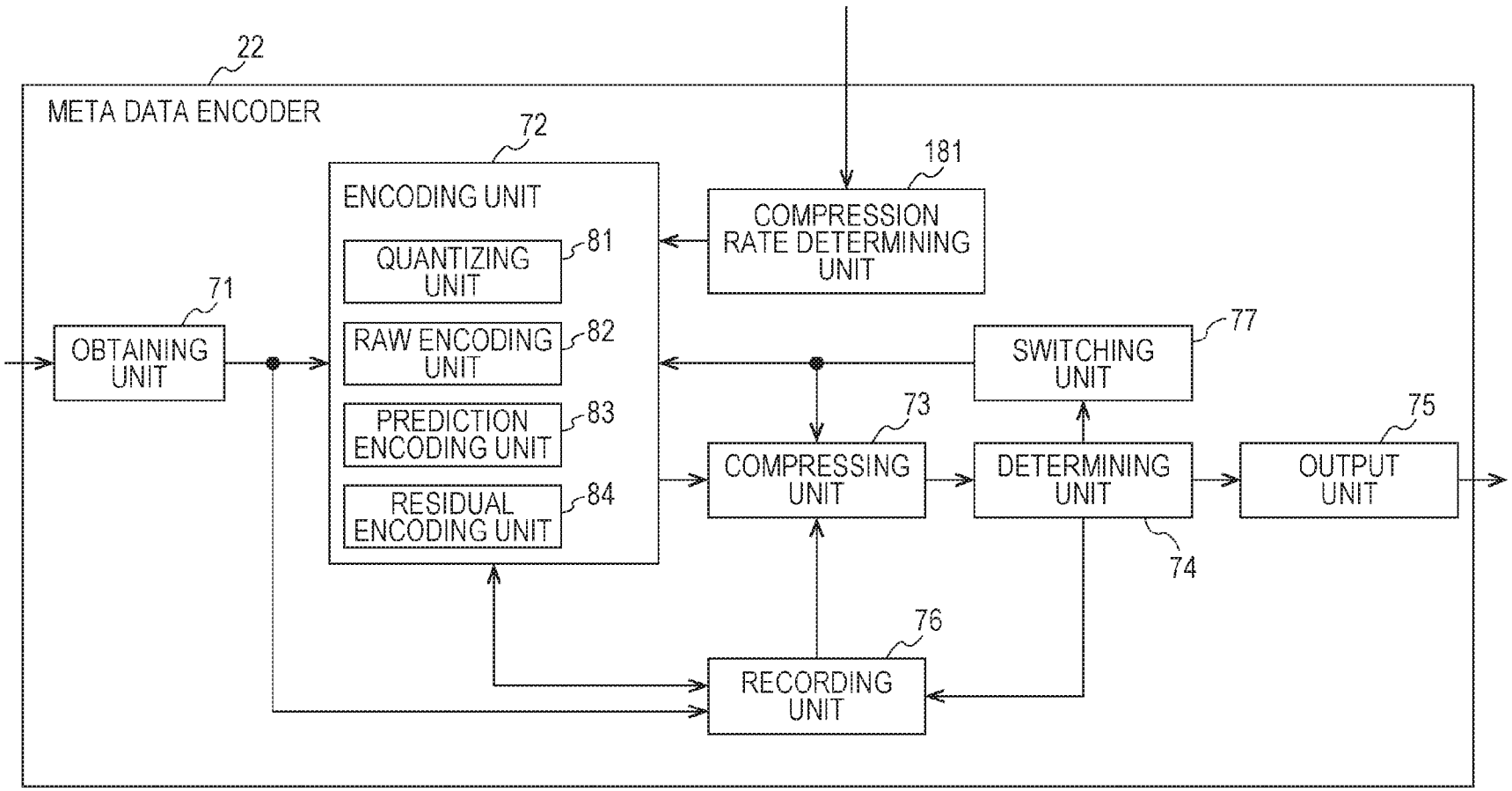
FIG. 12 is a figure illustrating an example of a configuration of a meta data encoder.

More specifically, for example, in a case where the step size R used in the expression (1) and the expression (2) explained above is dynamically determined on the basis of the audio data, the meta data encoder 22 is configured as shown in FIG. 12. In FIG. 12, the portions corresponding to the case of FIG. 4 are denoted with the same reference numerals, and the explanation thereabout is omitted as necessary.

The meta data encoder 22 as shown in FIG. 12 is provided with not only the meta data encoder 22 as shown in FIG. 4 but also a compression rate determining unit 181.

The compression rate determining unit 181 obtains audio data of each of N objects provided to the encoder 13, and determines the step size R of each object on the basis of the obtained audio data. Then, the compression rate determining unit 181 provides the determined step size R to the encoding unit 72.

In addition the quantizing unit 81 of the encoding unit 72 quantizes the position information about each object on the basis of the step size R provided from the compression rate determining unit 181.

<Explanation about Encoding Processing>

Figure 13:
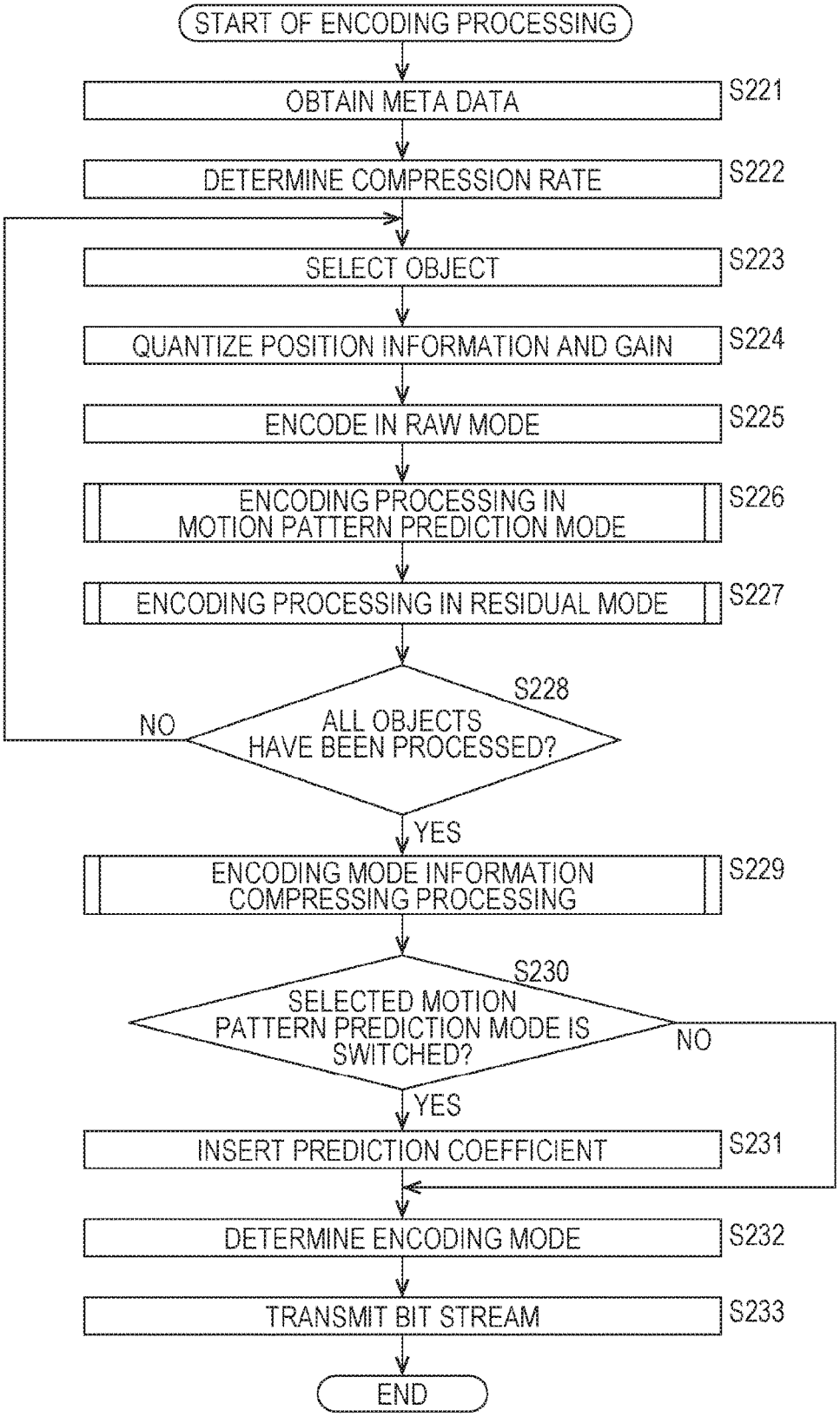
FIG. 13 is a flowchart for explaining encoding processing.

Subsequently, the encoding processing performed by the meta data encoder 22 as shown in FIG. 12 will be explained with the reference to the flowchart of FIG. 13.

It should be noted that the processing in step S221 is the same as the processing in step S11 of FIG. 5, and therefore the explanation thereabout is omitted.

In step S222, the compression rate determining unit 181 determines the compression rate of the position information for each object, on the basis of the feature quantity of the audio data provided from the encoder 13.

More specifically, for example, in a case where, for example, the magnitude of the signal (sound volume) serving as the feature quantity of the audio data of the object is equal to or more than a predetermined first threshold value, the compression rate determining unit 181 adopts the step size R of the object as the predetermined first value, and provides the predetermined first value to the encoding unit 72.

In a case where the magnitude of the signal (sound volume) serving as the feature quantity of the audio data of the object is less than the first threshold value, and is equal to or more than a predetermined second threshold value, the compression rate determining unit 181 adopts the step size R of the object as the predetermined second value larger than the first value, and provides the predetermined second value to the encoding unit 72.

As described above, when the sound volume of the audio of the audio data is high, the quantization resolution is increased, i.e., the step size R is decreased, so that more accurate position information can be obtained during the decoding.

In a case where the magnitude of the signal of the audio data of the object, i.e., the sound volume, is silent or so small that it can be hardly heard, the compression rate determining unit 181 does not transmit the position information and the gain of the object as the encoded meta data. In this case, the compression rate determining unit 181 provides, to the encoding unit 72, information indicating that the position information and the gain is not sent.

When the processing in step S222 is performed, thereafter, the processing in step S223 to step S233 is performed, and the encoding processing is terminated, but the processing is the same as the processing in step S12 to step S22 of FIG. 5, and therefore the explanation thereabout is omitted.

However, in the processing in step S224, the quantizing unit 81 uses the step size R provided from the compression rate determining unit 181 to quantize the position information about the object. The object for which the information indicating that the position information and the gain are not sent is provided from the compression rate determining unit 181 is not selected as the target of the processing in step S223, and the position information and the gain of the object are not transmitted as the encoded meta data.

Further, the step size R of each object is described in the encoded meta data by the compressing unit 73, and the encoded meta data are transmitted to the meta data decoder 32. The compressing unit 73 obtains the step size R of each object from the encoding unit 72 or the compression rate determining unit 181.

As described above, the meta data encoder 22 dynamically changes the step size R on the basis of the feature quantity of the audio data.

As described above, the step size R is dynamically changed, so that the step size R is decreased for an object of which sound volume is high and the degree of importance is high, so that more accurate position information can be obtained during the decoding. The position information and the gain are not transmitted for an object of which sound volume is almost silent and the degree of importance is low, so that the amount of data of the encoded meta data can be efficiently reduced.

In this case, the processing in the case where the magnitude of the signal (sound volume) is used as the feature quantity of the audio data has been explained. The feature quantity of the audio data may be a feature quantity other than that. For example, similar processing can be performed even in a case where the fundamental frequency (pitch) of the signal, the ratio between the power of the high frequency region and the power of the entire signal, the combination thereof, or the like is used as the feature quantity.

Figure 11:
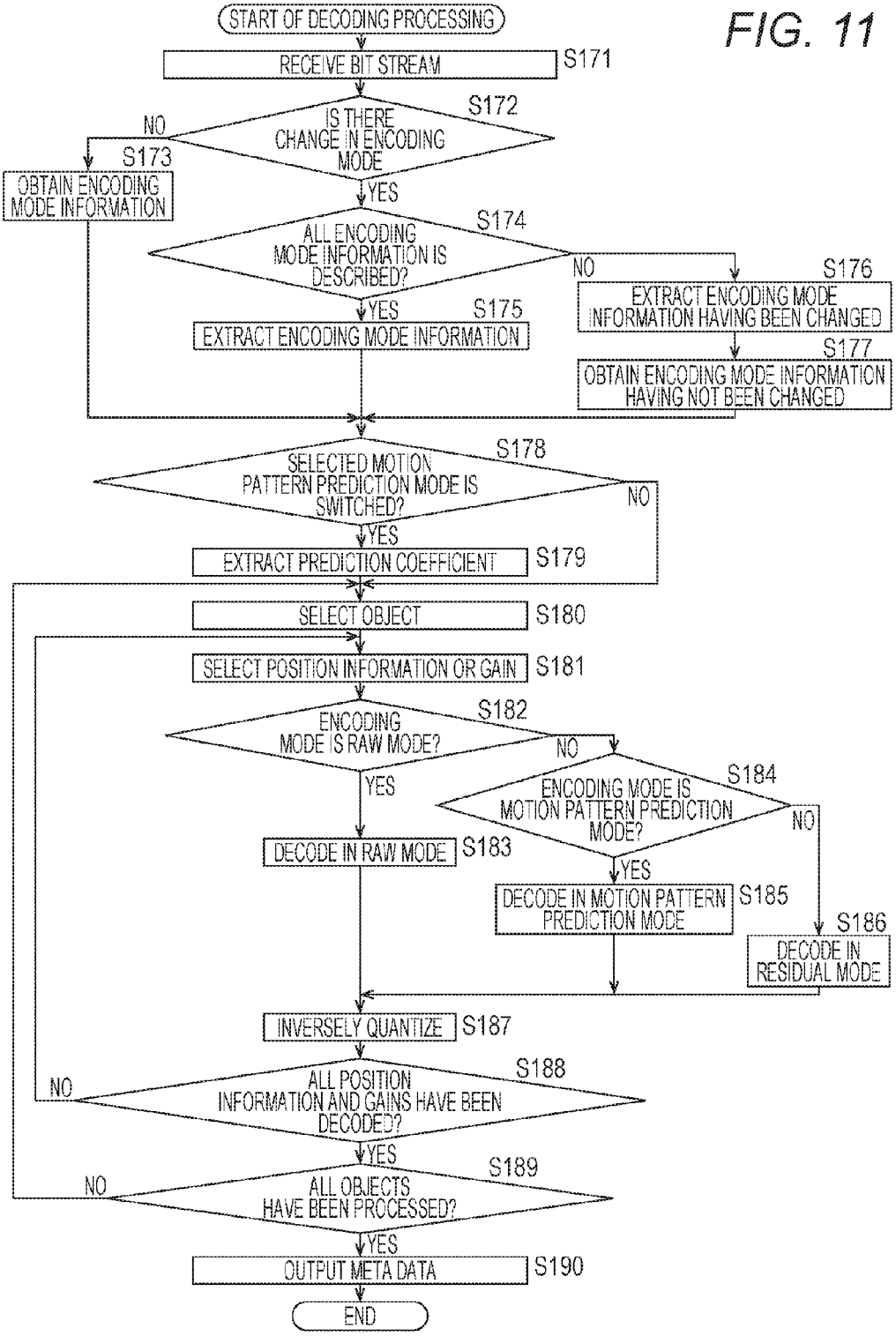
FIG. 11 is a flowchart for explaining decoding processing.

Further, even in a case where the encoded meta data are generated by the meta data encoder 22 as shown in FIG. 12, the decoding processing explained with reference to FIG. 11 is performed by the meta data decoder 32 as shown in FIG. 10 is performed.

However, in this case, the extracting unit 122 extracts the step size R of the quantization of each object from the encoded meta data provided from the obtaining unit 121 and provides the step size R to the decoding unit 123. Then, the inverse-quantizing unit 144 of the decoding unit 123 performs inverse quantization by using the step size R provided from the extracting unit 122 in step S187.

By the way, the series of processing explained above may be executed by hardware or may be executed by software. When the series of processing is executed by the software, a program constituting the software is installed to a computer. In this case the computer includes a computer incorporated into dedicated hardware and a general-purpose personal computer capable of, for example, executing various kinds of functions by installing various kinds of programs.

Figure 14:
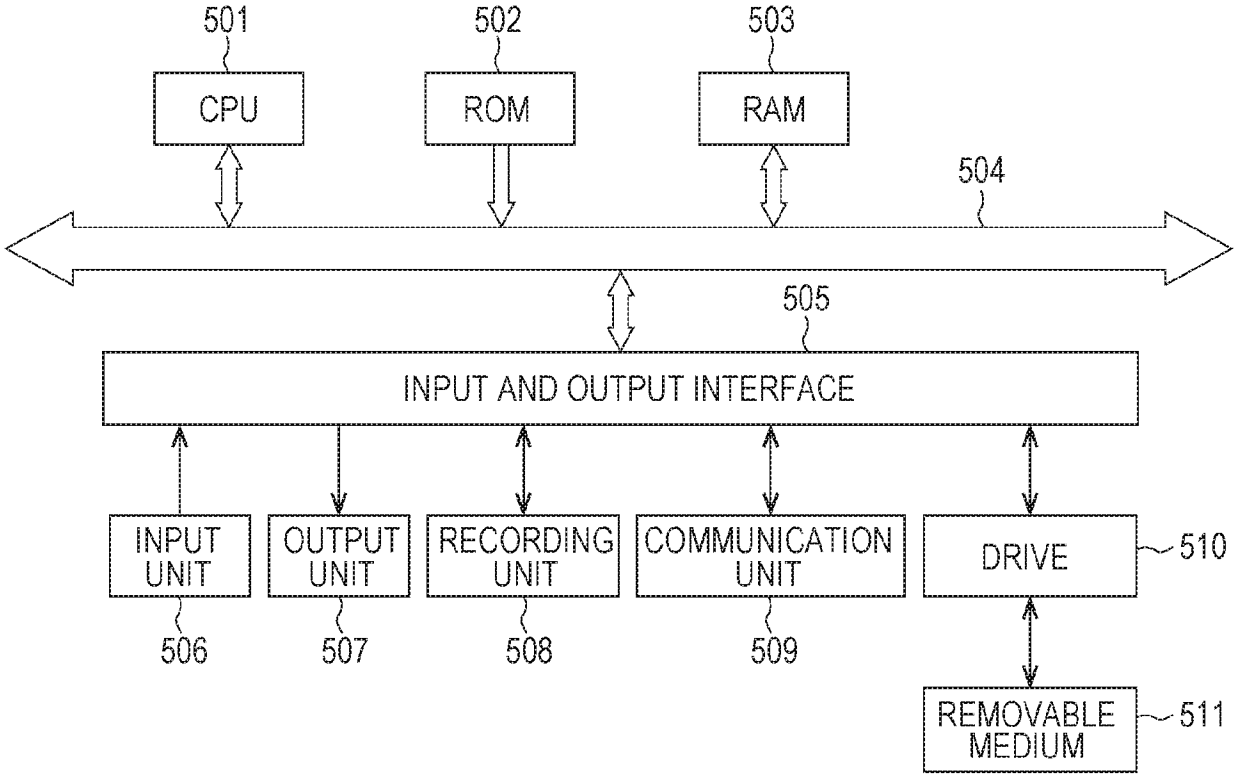
FIG. 14 is a figure illustrating an example of a configuration of a computer.

FIG. 14 is a block diagram illustrating an example of a configuration of hardware of a computer executing the above series of processing by using a program.

In the computer, a CPU (Central Processing Unit) 501, a ROM (Read Only Memory) 502, and a RAM (Random Access Memory) 503 are connected with each other by a bus 504.

Further, the bus 504 is connected with an input and output interface 505. The input and output interface 505 is connected to an input unit 506, an output unit 507, a recording unit 508, a communication unit 509, and a drive 510.

The input unit 506 is constituted by a keyboard, a mouse, a microphone, an image-capturing device, and the like. The output unit 507 is constituted by a display, a speaker, and the like. The recording unit 508 is constituted by a hard disk, a nonvolatile memory, and the like. The communication unit 509 is constituted by a network interface and the like. The drive 510 drives a removable medium 511 such as a magnetic disk, an optical disk, a magneto-optical disk, a semiconductor memory, or the like.

In the computer configured as described above, for example, the CPU 501 performs the above series of processing by executing the program stored in the recording unit 508 by loading the program to the RAM 503 via the input and output interface 505 and the bus 504.

For example, the program executed by the computer (CPU 501) may be provided by being recorded on a removable medium 511 serving as a package medium and the like. Alternatively, the program may be provided via wired or wireless transmission media such as a local area network, the Internet, and a digital satellite broadcasting.

In the computer, the program can be installed to the recording unit 508 via the input and output interface 505 by attaching the removable medium 511 to the drive 510. Alternatively, the program can be received by the communication unit 509 via a wired or wireless transmission media, and can be installed to the recording unit 508. Still alternatively, the program can be installed to the ROM 502 and the recording unit 508 in advance.

It should be noted that the program executed by the computer may be a program with which processing is performed in time sequence according to the order explained in this specification, or may be a program with which processing is performed in parallel or with necessary timing, e.g., upon call.

The embodiment of the present technique is not limited to the above embodiment. The embodiment of the present technique can be changed in various manners without deviating from the gist of the present technique.

For example, the present technique may be configured as a cloud computing for processing a single function in such a manner that it is distributed among multiple devices via a network in a cooperating manner.

Each step explained in the above flowchart may be executed by a single device, or may be distributed and executed by multiple devices.

Further, in a case where multiple pieces of processing are included in a single step, the multiple pieces of processing are included in the single step and may be executed by a single device, or may be distributed and executed by multiple devices.

Further, the present technique may be configured as follows.

[1]

An encoding device including:

an encoding unit for encoding position information about a sound source at a predetermined time in accordance with a predetermined encoding mode on the basis of the position information about the sound source at a time before the predetermined time;

a determining unit for determining any one of a plurality of encoding modes as the encoding mode of the position information; and an output unit for outputting encoding mode information indicating the encoding mode determined by the determining unit and the position information encoded in the encoding mode determined by the determining unit.

[2]

The encoding device according to [1], wherein the encoding mode is a RAW mode in which the position information is adopted as the encoded position information as it is, a stationary mode in which the position information is encoded while the sound source is assumed to be stationary, a constant speed mode in which the position information is encoded while the sound source is assumed to be moving with a constant speed, a constant acceleration mode in which the position information is encoded while the sound source is assumed to be moving with a constant acceleration, or a residual mode in which the position information is encoded on the basis of a residual of the position information.

[3]

The encoding device according to [1] or [2], wherein the position information is an angle in a horizontal direction, an angle in a vertical direction, or a distance indicating a position of the sound source.

[4]

The encoding device according to [2], wherein the position information encoded in the residual mode is information indicating a difference of an angle serving as the position information.

[5]

The encoding device according to any one of [1] to [4], wherein in a case where, with regard to a plurality of sound sources, the encoding modes of the position information of all the sound sources at the predetermined time are the same as the encoding mode at an immediately previous time of the predetermined time, the output unit does not output the encoding mode information.

[6]

The encoding device according to any one of [1] to [5], wherein in a case where, at the predetermined time, the encoding modes of the position information of some of a plurality of sound sources are different from the encoding mode at an immediately previous time of the predetermined time, the output unit outputs, of all the encoding mode information, only the encoding mode information of the position information of the sound sources of which encoding modes are different from that of the immediately previous time.

[7]

The encoding device according to any one of [1] to [6] further including:

a quantization unit for quantizing the position information with a predetermined quantizing width; and a compression rate determining unit for determining the quantizing width on the basis of a feature quantity of the audio data of the sound source, wherein the encoding unit encodes the quantized position information.

[8]

The encoding device according to any one of [1] to [7] further including a switching unit for switching the encoding mode in which the position information is encoded on the basis of the amount of data of the encoding mode information and the encoded position information which have been output in past.

[9]

The encoding device according to any one of [1] to [8], wherein the encoding unit further encodes a gain of the sound source, and the output unit further outputs the encoding mode information of the gain the encoded gain.

[10]

An encoding method including the steps of:

encoding position information about a sound source at a predetermined time in accordance with a predetermined encoding mode on the basis of the position information about the sound source at a time before the predetermined time;

determining any one of a plurality of encoding modes as the encoding mode of the position information; and outputting encoding mode information indicating the encoding mode determined and the position information encoded in the encoding mode determined.

[11]

A program for causing a computer to execute processing including the steps of:

encoding position information about a sound source at a predetermined time in accordance with a predetermined encoding mode on the basis of the position information about the sound source at a time before the predetermined time;

determining any one of a plurality of encoding modes as the encoding mode of the position information; and outputting encoding mode information indicating the encoding mode determined and the position information encoded in the encoding mode determined.

[12]

A decoding device including:

an obtaining unit for obtaining encoded position information about a sound source at a predetermined time and encoding mode information indicating an encoding mode, in which the position information is encoded, of a plurality of encoding modes; and a decoding unit for decoding the encoded position information at the predetermined time in accordance with a method corresponding to the encoding mode indicated by the encoding mode information on the basis of the position information about the sound source at a time before the predetermined time.

[13]

The decoding device according to [12], wherein the encoding mode is a RAW mode in which the position information is adopted as the encoded position information as it is, a stationary mode in which the position information is encoded while the sound source is assumed to be stationary, a constant speed mode in which the position information is encoded while the sound source is assumed to be moving with a constant speed, a constant acceleration mode in which the position information is encoded while the sound source is assumed to be moving with a constant acceleration, or a residual mode in which the position information is encoded on the basis of a residual of the position information.

[14]

The decoding device according to [12] or [13], wherein the position information is an angle in a horizontal direction, an angle in a vertical direction, or a distance indicating a position of the sound source.

[15]

The decoding device according to [13], wherein the position information encoded in the residual mode is information indicating a difference of an angle serving as the position information.

[16]

The decoding device according to any one of [12] to [15], wherein in a case where, with regard to a plurality of sound sources, the encoding modes of the position information of all the sound sources at the predetermined time are the same as the encoding mode at an immediately previous time of the predetermined time, the obtaining unit obtains only the encoded position information.

[17]

The decoding device according to any one of [12] to [16], wherein in a case where, at the predetermined time, the encoding modes of the position information of some of the plurality of sound sources are different from the encoding mode at an immediately previous time of the predetermined time, the obtaining unit obtains the encoded position information and the encoding mode information of the position information of the sound sources of which encoding modes are different from that of the immediately previous time.

[18]

The decoding device according to any one of [12] to [17], wherein the obtaining unit further obtains information about a quantizing width in which the position information is quantized during encoding of the position information, which is determined on the basis of a feature quantity of audio data of the sound source.

[19]

A decoding method including the steps of:

obtaining encoded position information about a sound source at a predetermined time and encoding mode information indicating an encoding mode, in which the position information is encoded, of a plurality of encoding modes; and decoding the encoded position information at the predetermined time in accordance with a method corresponding to the encoding mode indicated by the encoding mode information on the basis of the position information about the sound source at a time before the predetermined time.

[20]

A program for causing a computer to execute processing including the steps of:

obtaining encoded position information about a sound source at a predetermined time and encoding mode information indicating an encoding mode, in which the position information is encoded, of a plurality of encoding modes; and decoding the encoded position information at the predetermined time in accordance with a method corresponding to the encoding mode indicated by the encoding mode information on the basis of the position information about the sound source at a time before the predetermined time.

REFERENCE SIGNS LIST

22 Meta data encoder
32 Meta data decoder
72 Encoding unit
73 Compressing unit
74 Determining unit
75 Output unit
77 Switching unit
81 Quantizing unit
82 RAW encoding unit

83 Prediction encoding unit
84 Residual encoding unit
122 Extracting unit
123 Decoding unit
124 Output unit
141 RAW decoding unit
142 Prediction decoding unit
143 Residual decoding unit
144 Inverse-quantizing unit
181 Compression rate determining unit

The invention claimed is:

1. An encoding device, comprising:

at least one processor configured to:

determine an encoding mode for position information of a sound source from a plurality of encoding modes;

encode the position information of the sound source at a determined time in accordance with the determined encoding mode based on the position information of the sound source at a time before the determined time;

and output encoding mode information indicating the determined encoding mode and the encoded position information encoded in the determined encoding mode, wherein a first amount of data of the encoded position information output at the determined time is less than a second amount of data of the encoded position information output before the determined time.

2. The encoding device according to claim 1, wherein the encoding mode is one of:

a RAW mode in which the position information is adopted as the encoded position information, a stationary mode in which the position information is encoded while the sound source is assumed to be stationary, a constant speed mode in which the position information is encoded while the sound source is assumed to move with a constant speed, a constant acceleration mode in which the position information is encoded while the sound source is assumed to move with a constant acceleration, or a residual mode in which the position information is encoded based on a residual of the position information.

3. The encoding device according to claim 2, wherein the position information is a first angle in a horizontal direction, a second angle in a vertical direction, or a distance indicating a position of the sound source.

4. The encoding device according to claim 2, wherein the position information encoded in the residual mode is information indicating a difference of an angle.

5. The encoding device according to claim 2, wherein, based on presence of a plurality of sound sources, encoding modes of the position information of all the plurality of sound sources at the determined time are same as the encoding mode at the time before the determined time, the at least one processor is further configured to stop output of the encoding mode information.

6. The encoding device according to claim 2, wherein, at the determined time, encoding modes of the position information of a subset of a plurality of sound sources are different from the encoding mode at the time before the determined time, the at least one processor is further configured to output the encoding mode information of the position information of the subset of the plurality of sound sources.

7. The encoding device according to claim 2 wherein the at least one processor is further configured to:

quantize the position information with a quantizing width;

determine the quantizing width based on a feature quantity of audio data of the sound source, wherein the at least one processor is further configured to encode the quantized position information.

8. The encoding device according to claim 2, wherein the at least one processor is further configured to switch the encoding mode in which the position information is encoded based on the second amount of data of the encoding mode information and the encoded position information which have been output in past.

9. The encoding device according to claim 2, wherein the at least one processor is further configured to encode a gain of the sound source, and output the encoded gain.

10. An encoding method, comprising:

determining an encoding mode for position information of a sound source from a plurality of encoding modes;

encoding position information of the sound source at a determined time in accordance with the determined encoding mode based on the position information of the sound source at a time before the determined time;

and outputting encoding mode information indicating the determined encoding mode and the encoded position information encoded in the determined encoding mode, wherein a first amount of data of the encoded position information output at the determined time is less than a second amount of data of the encoded position information output before the determined time.

11. A non-transitory computer-readable medium having stored thereon, computer-executable instructions which, when executed by a computer, cause the computer to execute operations, the operations comprising:

determining an encoding mode for position information of a sound source from a plurality of encoding modes;

encoding position information of the sound source at a determined time in accordance with the determined encoding mode based on the position information of the sound source at a time before the determined time;

and outputting encoding mode information indicating the determined encoding mode and the encoded position information encoded in the determined encoding mode, wherein a first amount of data of the encoded position information output at the determined time is less than a second amount of data of the encoded position information output before the determined time.

12. A decoding device, comprising:

at least one processor configured to:

obtain encoded position information of a sound source at a determined time and encoding mode information indicating an encoding mode in which position information is encoded, wherein the encoding mode is selected from a plurality of encoding modes; and decode the encoded position information at the determined time in accordance with a method corresponding to the encoding mode indicated by the encoding mode information and based on the position information of the sound source at a time before the determined time, wherein a first amount of data of the encoded position information obtained at the determined time is less than a second amount of data of the encoded position information obtained before the determined time.

13. The decoding device according to claim 12, wherein the encoding mode is one of:

a RAW mode in which the position information is adopted as the encoded position information, a stationary mode in which the position information is encoded while the sound source is assumed to be stationary, a constant speed mode in which the position information is encoded while the sound source is assumed to move with a constant speed, a constant acceleration mode in which the position information is encoded while the sound source is assumed to move with a constant acceleration, or a residual mode in which the position information is encoded based on a residual of the position information.

14. The decoding device according to claim 13, wherein the position information is a first angle in a horizontal direction, a second angle in a vertical direction, or a distance indicating a position of the sound source.

15. The decoding device according to claim 13, wherein the position information encoded in the residual mode is information indicating a difference of an angle.

16. The decoding device according to claim 13, wherein, based on presence a plurality of sound sources, encoding modes of the position information of all the plurality of sound sources at the determined time are same as the encoding mode at the time before the determined time, the at least one processor is further configured to obtain the encoded position information.

17. The decoding device according to claim 13, wherein, at the determined time, encoding modes of the position information of a subset of a plurality of sound sources are different from the encoding mode at the time before the determined time, the at least one processor is further configured to obtain the encoded position information and the encoding mode information of the position information of the subset of the plurality of sound sources.

18. The decoding device according to claim 13, wherein the at least one processor is further configured to obtain information of a quantizing width in which the position information is quantized during encoding of the position information, wherein the quantizing width is determined based on a feature quantity of audio data of the sound source.

19. A decoding method, comprising:

obtaining encoded position information of a sound source at a determined time and encoding mode information indicating an encoding mode in which position information is encoded, wherein the encoding mode is selected from a plurality of encoding modes; and decoding the encoded position information at the determined time in accordance with a method corresponding to the encoding mode indicated by the encoding mode information and based on the position information of the sound source at a time before the determined time, wherein a first amount of data of the encoded position information obtained at the determined time is less than a second amount of data of the encoded position information obtained before the determined time.

20. A non-transitory computer-readable medium having stored thereon, computer-executable instructions which, when executed by a computer, cause the computer to execute operations, the operations comprising:

obtaining encoded position information of a sound source at a determined time and encoding mode information indicating an encoding mode in which position information is encoded, wherein the encoding mode is selected from a plurality of encoding modes; and decoding the encoded position information at the determined time in accordance with a method corresponding to the encoding mode indicated by the encoding mode information and based on the position information of the sound source at a time before the determined time, wherein a first amount of data of the encoded position information obtained at the determined time is less than a second amount of data of the encoded position information obtained before the determined time.

* * * * *